US006958730B2

(12) United States Patent
Nagumo et al.

(10) Patent No.: US 6,958,730 B2
(45) Date of Patent: Oct. 25, 2005

(54) ANTENNA DEVICE AND RADIO COMMUNICATION EQUIPMENT INCLUDING THE SAME

(75) Inventors: Shoji Nagumo, Kawasaki (JP); Kengo Onaka, Yokohama (JP); Takashi Ishihara, Machida (JP); Jin Sato, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/100,122

(22) Filed: Mar. 19, 2002

(65) Prior Publication Data

US 2002/0163470 A1 Nov. 7, 2002

(30) Foreign Application Priority Data

May 2, 2001 (JP) ..... 2001-135310

(51) Int. Cl.[7] ..... H01Q 1/24
(52) U.S. Cl. ..... 343/702; 343/829; 343/846
(58) Field of Search ..... 343/700 MS, 702, 343/713, 795, 829, 830, 846, 848, 833, 834

(56) References Cited

U.S. PATENT DOCUMENTS

| | | | | |
|---|---|---|---|---|
| 5,264,858 | A * | 11/1993 | Shiina | 343/713 |
| 5,457,470 | A * | 10/1995 | Hai et al. | 343/828 |
| 5,696,517 | A * | 12/1997 | Kawahata et al. | 343/700 MS |
| 6,191,751 | B1 * | 2/2001 | Johnson | 343/834 |
| 6,307,512 | B1 | 10/2001 | Geeraert | |
| 6,333,716 | B1 | 12/2001 | Pontoppidan | |
| 6,271,794 | B1 | 8/2002 | Geeraert | |
| 6,441,791 | B1 * | 8/2002 | Oka | 343/713 |

FOREIGN PATENT DOCUMENTS

| | | |
|---|---|---|
| EP | 0 655 797 A1 | 5/1995 |
| EP | 0 790 663 A1 | 8/1997 |
| EP | 0 831 547 A2 | 3/1998 |
| EP | GB 2 355 114 A | 4/2001 |
| EP | 1 143 558 A2 | 10/2001 |
| JP | 06-069715 | 3/1994 |
| JP | 06-181997 | 7/1994 |
| JP | 06-291530 | 10/1994 |
| JP | 08-250917 | 9/1996 |
| JP | 10-093332 | 4/1998 |
| JP | 10-200327 | 7/1998 |
| JP | 10-247807 | 9/1998 |
| JP | 11-004117 | 1/1999 |
| JP | 11-127014 | 5/1999 |
| JP | 2000-134027 | 5/2000 |
| JP | 2000-151258 | 5/2000 |
| JP | 2001-007639 | 1/2001 |
| JP | 2001-68917 | 3/2001 |
| WO | WO 01/18909 A1 | 3/2001 |
| WO | WO 01/24316 A1 | 4/2001 |
| WO | WO 01/33665 A1 | 5/2001 |

* cited by examiner

*Primary Examiner*—Michael C. Wimer
(74) *Attorney, Agent, or Firm*—Keating & Bennett, LLP

(57) ABSTRACT

A feed radiation electrode including two branched radiation electrodes is provided on the surface of a substrate. Non-feed radiation electrodes are provided on both sides of the feed radiation electrode and near the branched radiation electrodes. The branched radiation electrode and the non-feed radiation electrode are double-resonated in the same frequency band. The branched radiation electrode and the non-feed radiation electrode are double-resonated in the same frequency band which is higher than that of the branched radiation electrode and the non-feed radiation electrode.

15 Claims, 11 Drawing Sheets

ANTENNA DEVICE AND RADIO COMMUNICATION EQUIPMENT INCLUDING THE SAME

BACKGROUND OF THE INVENTION

1. Field of the Invention

The present invention relates to an antenna device, and more particularly, to a multi-band antenna device and radio communication equipment using the antenna device.

2. Description of the Related Art

Recently, portable telephones often include a dual band system using two frequency bands, e.g., those of 800 to 900 MHz and 1800 to 1900 MHz. Reverse F-shaped antennas for receiving and transmitting two frequency bands from a single antenna have been proposed. For example, Japanese Unexamined Patent Application Publication No. Hei, 10-93332 discloses an antenna has resonance frequencies of 1500 MHz and 1900 MHz.

As shown in FIG. 15, this antenna includes a slit 2 provided in a conductor plate 1 to define two radiation conductor plates 3 and 4 having different widths and lengths. A portion of the conductor plate 1 is bent to form a connection conductor plate 5. The radiation conductor plates 3 and 4 are supported on a ground conductor plate 6 by the connection conductor plate 5. High frequency power is supplied to the radiation conductor plates 3 and 4 via a feeding pin 7.

Moreover, the U.S. Pat. Nos. 6,271,794, 6,307,512 and 6,333,716 disclose an antenna in which two metallic patterns having different electrical lengths are provided on the surface of a case for a telephone to produce two radiation elements, such that the antenna has resonance frequencies of 900 MHz and 1800 MHz. This antenna includes a slit provided between the two metallic patterns to enable adjustment of the bandwidths of the resonance frequencies.

According to the examples of the prior art, each antenna is a dual band antenna having two resonance frequencies in frequency bands separated from each other, but has a single resonance characteristic in each frequency band. Accordingly, the size of the antenna must be increased to ensure a necessary bandwidth for each resonance frequency. Thus the size of the antenna cannot be reduced. Moreover, when frequency bands having a single resonance are provided, respectively, the resonance characteristics have a single peak. Thus, a wide frequency band cannot be achieved.

SUMMARY OF THE INVENTION

In order to overcome the above-described problems, preferred embodiments of the present invention provide an antenna device having a plurality of frequency bands and which achieves double-resonance in the respective frequency bands.

Another preferred embodiment of the present invention provides radio communication equipment including the antenna device having a plurality of feed radiation electrode bands and double-resonance in the respective frequency bands.

According to a first preferred embodiment of the present invention, an antenna device is provided which includes a substrate made of a dielectric or a magnetic material, a feed element including a feeding terminal and a feed radiation electrode electrically connected to the feeding terminal, and a plurality of non-feed elements each including a ground terminal and a non-feed radiation electrode electrically connected to the ground terminal, the feed radiation electrode and the non-feed radiation electrodes are arranged on the surface of the substrate such that the non-feed radiation electrodes extend in the vicinity of and along the feed radiation electrode.

When signal power is supplied to the feed terminal including a feed electrode or a feeding pin, the feed element has at least one resonance frequency. That is, when the feed element includes a single feed radiation electrode resonates at the frequencies of the fundamental wave and its higher-order harmonics which is determined by the electrical length of the feed radiation electrode. Moreover, the feed element, which includes a plurality of branched radiation electrodes, is resonated at the resonance frequencies of the respective branched radiation electrodes which are determined by the effective line lengths of the branched radiation electrodes.

When the non-feed radiation electrode of, e.g., the non-feed radiation electrode positioned on the right side of the feed element of the plurality of non-feed radiation electrodes has an electrical line length greater than that of the non-feed radiation electrode of the non-feed element positioned on the left side of the feed element, and the feed element includes a single feed radiation electrode, the non-feed radiation electrode on the right side resonates at a resonance frequency near the frequency of the fundamental wave. When the feed element includes a plurality of branched radiation electrodes, the non-feed radiation electrode on the right side resonates at a resonance frequency near the lowest resonance frequency in the plurality of branched radiation electrodes. The non-feed radiation electrode on the left side having a smaller effective line length than that of the non-feed radiation electrode on the right side resonates at a frequency near one resonance frequency of the higher-order harmonics caused when the feed element includes the single feed radiation electrode, or resonates at a frequency near the highest resonance frequency in the branched radiation electrodes.

Both of resonance frequencies adjacent to each other can be provided, and also, matching of the double-resonance in the respective frequency bands by the above-described operation of the feed element and the non-feed elements is achieved. Moreover, the resonance frequencies of the fundamental wave and its higher-order harmonics of the feed element and the resonance frequencies of the respective branched radiation electrodes are set in frequency bands separated from each other. Thus, with one antenna, a plurality of types of double-resonance is produced without mutual interference. In addition, the bandwidths of the respective frequency bands are greatly increased due to the double-resonance. The term "double-resonance" means that the resonance frequencies of a feed element and non-feed elements exist in the vicinity to each other, and the bandwidth of a frequency band containing the resonance frequencies is greatly increased.

Preferably, the feed radiation electrode includes a plurality of branched radiation electrodes having the feeding terminal as a common terminal.

According to the above-described preferred embodiment, the effective line lengths of the plurality of branched radiation electrodes are different from each other. Thereby, the feed element has a plurality of resonance frequencies different from each other. In other words, the resonance frequencies of the branched radiation electrodes are set to be different from each other, and moreover, the resonance frequencies of the branched radiation electrodes are set in different frequency bands.

Preferably, the branched radiation electrodes have effective line lengths at which the branched radiation electrodes are excited at different resonance frequencies.

Therefore, the branched radiation electrodes are excited at resonance frequencies independent of each other. Thus, resonance frequencies are higher in the arrangement order of the branched radiation electrodes, and also frequency bands different for the resonance frequencies are set. For example, when the feed radiation electrode includes two branched radiation electrodes, one resonance frequency is set to a frequency band of 800 to 900 MHz which is commonly used in portable telephones, and the other resonance frequency is set to a frequency band of 1800 to 1900 MHz. Moreover, one branched radiation electrode is excited by the fundamental wave of the feed element, and the other branched radiation electrode is excited by the higher-order harmonics of the fundamental wave such as the double harmonic wave or the triple harmonic wave.

Preferably, the feed radiation electrode is defined by a single radiation electrode, and the single radiation electrode has an effective line length at which the single radiation electrode is excited at the resonance frequency of the fundamental wave and the resonance frequencies of the higher-order harmonics, caused by feeding via the feeding terminal.

Accordingly, the feed radiation electrode has an effective line length at which the electrode is resonated at the frequency of the fundamental wave. The feed element has an electrical length at which the element is resonated at the frequency of the fundamental wave and the frequency obtained by multiplying the frequency of the fundamental frequency by an integral number. Accordingly, by setting the resonance frequency of the fundamental wave to the lowest frequency of the used frequencies, the double or triple harmonic wave of the fundamental wave is set to the other frequency.

Also, preferably, each of the non-feed radiation electrodes extends from the ground terminal with the other end thereof defining an open end, each of the branched radiation electrodes extends from the feeding terminal with the other end thereof defining an open end, and the open-ends of the branched radiation electrodes are arranged to be spaced from each other.

According to the above-described configuration, one branched radiation electrode and the non-feed radiation electrode adjacent to the branched radiation electrode defines a double resonance pair. Moreover, by gradually increasing the width of a slit provided in the plane of the feed radiation electrode to divide the feed radiation electrode into the plural branched radiation electrodes, the mutual interference between the double-resonance pairs is greatly reduced, and matching of the double-resonance is efficiently achieved.

Preferably, capacitance-charging electrodes are provided in the open ends of the radiation electrodes on side-surfaces of the substrate.

According to the above-described configuration, fringing capacities (stray capacities) in the open ends of the respective radiation electrodes define the open end capacities (electrostatic capacities) between the capacitance-charging electrodes and the ground patterns of the circuit substrate. Thus, the coupling capacities between the feed element and the non-feed elements are easily balanced, and adjustment is easily performed produce the double-resonance in the same frequency band.

Preferably, the antenna device further includes a rectangular circuit substrate, the substrate is arranged near one corner of the circuit substrate where the two sides of the circuit substrate intersect each other while one of the non-feed radiation electrodes is arranged along one of the two sides, and the other non-feed radiation electrode is arranged along the other side.

According to this configuration, ground patterns and wiring patterns provided on the circuit substrate define paths for high frequency currents, such that case-currents are excited along the sides of the circuit substrate electric-field-coupled to the respective non-feed elements. The case-currents cause the gains of the non-feed elements, which are indirect-feed elements, to increase substantially. Moreover, since the substrate of the antenna device is arranged near the corner of the circuit substrate, the electric field coupling between the non-feed elements and the circuit substrate is reduced, such that the electrical Q factor at resonance is greatly reduced. Thus, the bandwidths of the frequency bands in which the double-resonance occurs is greatly increased.

According to a second preferred embodiment of the present invention, an antenna device is provided which includes a plurality of antennas, and a circuit substrate having the plurality of antennas disposed thereon, the plurality of antennas each include a feed element having a feeding terminal and a feed radiation electrode extending from the feeding terminal, and a non-feed element having a ground electrode and a non-feed radiation electrode extending from the ground electrode, the feed element and the non-feed element are provided on a substrate, the feed radiation electrode and the non-feed radiation electrode of each antenna have effective line lengths different from each other, the circuit substrate is provided with a ground pattern connecting the ground electrodes to each other and a feeding pattern connecting the feeding terminals to a common signal source.

Therefore, the circuit substrate is included as a portion of the antenna device, and the electrical volume of the antenna device is determined by the area of the circuit substrate. In particular, when the size of the antenna device is increased to enhance the transmission output, the size of the circuit substrate is simply increased. Thus, the arrangement of the plurality of antennas on the circuit substrate is determined based on the degree of the mutual interference, performances required for the directivities of the antennas, and other factors. Since the antennas are configured to be double-resonated in different frequency bands, and a large signal current flows through the feeding pattern, the transmission output of the antenna device is greatly enhanced.

Preferably, filter circuits are provided in the paths of the feeding pattern which is branched from the portion thereof connecting the feeding terminals to the common signal source and extended toward the feeding terminals, respectively.

According to the above-described configuration, signals outside of the frequency bands in which the respective antennas are excited are excluded. That is, only signals that excite the respective antennas are supplied to the respective antennas. Accordingly, separation between the frequency bands of the antennas is greatly improved.

Preferably, non-feed radiation electrodes are provided on both sides of and near the feed radiation electrode on the surface of each substrate.

Since the non-feed radiation electrodes are provided on both sides of each feed radiation electrode, each antenna is configured as an antenna which is double-resonated in two frequency bands. Accordingly, the antenna device includes at least four frequency bands. Thus, the antenna device operates as a multi-band antenna by setting the frequency bands to be different from each other.

The feeding terminal is preferably a feed electrode provided on a side-surface of the substrate or a terminal pin passing through the substrate, depending upon the required specifications.

According to the above-described configuration, the feeding terminal configuration is selected from a variety of suitable shapes. Particularly, the antenna device is configured as one of a reversed L-shaped antenna and a reversed F-shaped antenna.

According to preferred embodiments of the present invention, radio communication equipment is provided which includes one of the above-described antenna devices, and a circuit substrate having an elongated rectangular shape including long and short sides, the antenna device has a width that is substantially equal to the length of one short side of the circuit substrate and is arranged along one short side and both long sides of the circuit substrate, the open end of one of the non-feed radiation electrodes is arranged to face the long side of the circuit substrate, and the open end of the other non-feed radiation electrode is arranged to face the other long side.

According to the radio communication equipment according to preferred embodiments of the present invention, case-currents occurring in two frequency bands are excited along the long sides and the short side of the circuit substrate. Thereby, the gain of the non-feed element arranged along the sides of the circuit substrate is greatly enhanced. Moreover, since the open ends of the two non-feed radiation electrodes arranged along the long sides and the short side of the circuit substrate are opposite to each other, the mutual interference between the adjacent non-feed elements is greatly reduced, and the separation between the frequency bands is greatly improved.

Moreover, since the three edges of the antenna device are positioned near the ends of the circuit substrate, the electric-field-coupling between the non-feed element arranged along the ends of the circuit substrate and the circuit substrate is reduced, such that the electrical Q factor of the double-resonant characteristic is greatly reduced and the bandwidths of the frequency bands are greatly increased. When the resonance frequency of one of the frequency bands of the non-feed elements coincides with the resonance condition of the case-current excited along the sides of the circuit substrate, the gain at the resonance frequency is greatly increased.

Preferably, in the radio communication equipment according to preferred embodiments of the present invention, the feed radiation electrode extends from the feeding terminal and includes an open end, the non-feed radiation electrodes extend from the ground terminals and include open ends, respectively, the open end at the top of one non-feed radiation electrode having an effective line length that is greater than the other non-feed radiation electrode is arranged opposite to the direction in which the long side of the circuit substrate extends so as to be spaced from the non-feed radiation electrode.

According to the above-described configuration, the substrate edge on the long-side side of the circuit substrate acts as an antenna which operates in the lower frequency band of the antenna device. Thus, the gain is increased. The gain of the antenna of a small potable telephone is greatly enhanced at a frequency in the 800 to 900 MHz band.

According to preferred embodiments of the present invention, radio communication equipment is provided which includes one of the above-described antenna devices, and a circuit substrate including a transmission-reception circuit for radio waves, each ground terminal of the antenna device being connected to a ground terminal of the circuit substrate, the feeding terminal being connected to an input-output terminal of the transmission-reception circuit.

The radio communication device having the antenna device mounted therein achieves multi-band communication in wide frequency bands.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
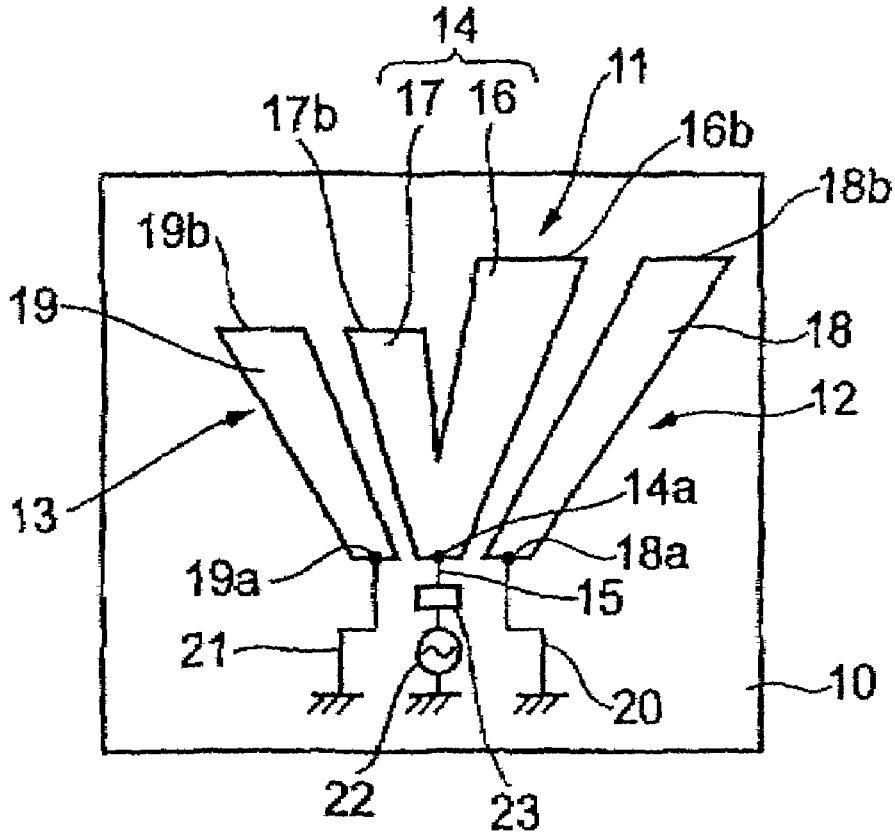
FIG. 1 is a schematic illustration of the basic configuration of an antenna device according to preferred embodiments of the present invention.
Figure 2:
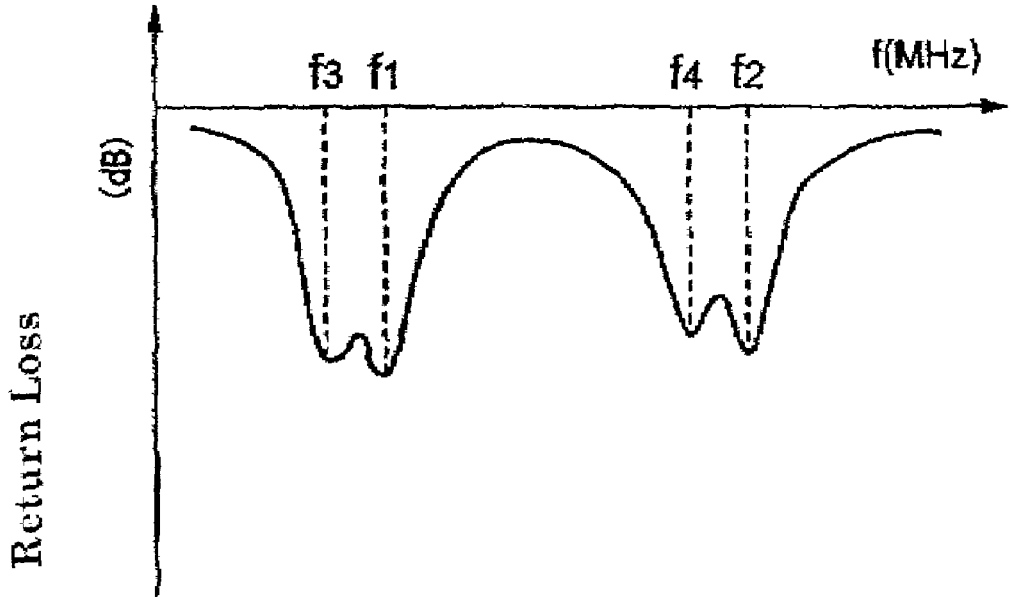
FIG. 2 is a graph of the frequency characteristic showing the return loss of the antenna device of FIG. 1.

Hereinafter, preferred embodiments of the present invention will be described with reference to the drawings. FIG. 1 shows the basic configuration of an antenna device according to preferred embodiments of the present invention. FIG. 2 shows the characteristic curve of the antenna device of FIG. 1 which illustrates the double resonance of the device. For simplification, a preferred embodiment including two feed elements and two non-feed elements will be described by way of an example.

In FIG. 1, a substrate 10 is formed of a dielectric material, and has a rectangular surface. A feed element 11 is provided on the surface of the substrate 10. A non-feed element 12 is provided on the right side of the feed element 11 in the vicinity thereof. Moreover, a non-feed element 13 is provided on the left side of the feed element 11 in the vicinity thereof, and has a resonance frequency different from that of the non-feed element 12.

The feed element 11 includes a feed radiation electrode 14 and a feed terminal 15 connected to a feeding end 14*a* of the feed radiation electrode 14. The feed radiation electrode 14 includes branched radiation electrodes 16 and 17 which are branched into a substantially Y-shape having the feeding end 14*a* in common, and having lengths that are different from each other. The non-feed elements 12 and 13 include strip-shaped non-feed radiation electrodes 18 and 19, and ground ends 20 and 21 connected to ground terminals 18*a* and 19*a* of the non-feed radiation electrodes 18 and 19, respectively.

The branched radiation electrodes 16 and 17 of the feed element 11 are configured such that the ends of the electrodes 16 and 17 opposite to the feeding end 14*a* define open ends 16*b* and 17*b*. The branched radiation electrode 16 has an effective line length which causes the electrode 16 to be excited at a resonance frequency f1. The branched radiation electrode 17 has an effective line length which causes the electrode 17 to be excited at a resonance frequency f2. When a signal power is supplied to these branched radiation electrodes 16 and 17 from a signal source 22 connected to the feeding terminal 15 via an impedance matching circuit 23, the feed element 11 is excited at the two resonance frequencies f1 and f2 (f2>f1).

In other words, the feed element 11 has an electrical length which includes that of the branched radiation electrode 16 and an electrical length which includes that of the branched radiation electrode 17. The branched radiation electrode 16 side of the feed element 11 resonates at the resonance frequency f1, while the branched radiation electrode 17 side of the feed element 11 resonates at the resonance frequency f2. The frequency bands in which the resonance frequencies f1 and f2 occur are separated such that no mutual interference occurs therebetween.

The sides opposite to the ground ends 18*a* and 19*a* of the non-feed radiation electrodes 18 and 19 define open ends 18*b* and 19*b*, respectively, similarly to the feed element 11. The non-feed radiation electrodes 18 and 19 of the non-feed element 12 and 13 are excited by electromagnetic-field-coupling to the feed element 11. That is, the non-feed radiation electrode 18 of the non-feed element 12 is electromagnetic-field-coupled primarily to the branched radiation electrode 16 of the feed element 11. The non-feed radiation electrode 19 of the non-feed element 13 is electromagnetic-field-coupled primarily to the branched radiation electrode 17 of the feed element 11.

In this case, the non-feed radiation electrode 18 of the non-feed element 12 has an effective line length which is substantially equal to that of the branched radiation electrode 16. The electrical length of the non-feed element 12 including that of the ground terminal 20 is less than that of the branched radiation electrode 16 side of the feed element 11. The non-feed radiation electrode 18 is excited at a frequency f3 near the resonance frequency f1 of the branched radiation electrode 16 side of the feed element 11.

The non-feed radiation electrode 19 of the non-feed element 13 has an effective line length which is substantially equal to that of the branched radiation electrode 17. The electrical length of the non-feed element 13 including that of the ground terminal 21 is less than that of the branched radiation electrode 17 side of the feed element 11. The non-feed radiation electrode 19 is excited at a frequency f4 near the resonance frequency f2 of the branched radiation electrode 17 side. The impedance matching circuit 23 matches the impedance of the feed radiation electrode 14 with that of the signal source 22.

In the above-described configuration, the effective line lengths of the branched radiation electrode 16 and the non-feed radiation electrode 18 are set such that the electrodes 17 and 19 are excited in a common frequency band, for example, in the frequency band of 800 to 900 MHz. Moreover, the effective line lengths of the branched radiation electrode 16 and the non-feed radiation electrode 18 are set such that the electrodes 16 and 18 are excited in a frequency band higher than the resonance frequency f1 of the branched radiation electrode 16, for example, in the frequency band of 1800 to 1900 MHz.

The interval between the side edges opposed to each other of the branched radiation electrodes 16 and 17 of the feed radiation electrode 14 is gradually increased toward the open ends 16*b* and 17*b*. This prevents deterioration of the resonance characteristic which is caused by the mutual interference of the electric-field-coupling. Moreover, the non-feed radiation electrodes 18 and 19 are disposed in the vicinities of the branched radiation electrodes 16 and 17, respectively. Referring to the intervals between the side-edges opposed to each other of the branched radiation electrode 16 and the non-feed radiation electrode 18 and between those of the branched radiation electrode 17 and the non-feed radiation electrode 19, the intervals between the feeding end 14*a* of the feed radiation electrode 14 and the ground end 18*a* of the non-feed radiation electrode 18 and between the feeding end 14*a* and the ground end 19*a* of the non-feed radiation electrode 19 are set to be greater than the intervals between the open end 16*b* of the branched radiation electrode 16 and the open end 18*b* of the non-feed radiation electrode 18 and between the open end 17*b* of the branched radiation electrode 17 and the open end 19*b* of the non-feed radiation electrode 19, respectively. Thus, excessive electric field coupling between the feed element 11 and the non-feed elements 12 and 13 is controlled, respectively.

According to the above-described configuration, when a transmission signal is supplied from the signal source 22 to the feed radiation electrode 14, the branched radiation electrodes 16 and 17 of the feed element 11 are excited at the resonance frequencies f1 and f2, respectively. At this time, the non-feed elements 12 and 13 are electromagnetic field coupled to the feed element 11. With the above-described electrode arrangement of the feed element 11 and the non-feed elements 12 and 13, the magnetic-field-coupling between the feeding terminal 15 side of the feed element 11 and the ground terminal 20 side of the non-feed radiation electrode 18 and between the feeding terminal 15 side of the feed element 11 and the ground terminal 21 side of the non-feed radiation electrode 19, and also, the electric-field-coupling between the open end 16*b* side of the branched radiation electrode 16 and the open end 18*b* side of the non-feed radiation electrode 18 and between the open end 17*b* of the branched radiation electrode 17 and the open end 19*b* of the non-feed radiation electrode 19 are adjusted.

Thus, the branched radiation electrode 16 and the non-feed radiation electrode 18 have include both of the resonance frequencies f1 and f3, and the frequencies f1 and f3 are near each other. For example, the branched radiation electrode 16 and the non-feed radiation electrode 18 are double-resonated in a frequency band of 800 to 900 MHz. Referring to the resonance frequency f2 of the branched radiation electrode 17 and the resonance frequency f4 of the non-feed radiation electrode 19, similarly, the branched radiation electrode 17 and the non-feed radiation electrode 19 are double-resonated at the frequencies f2 and f4 higher than the resonance frequencies f1 and f3 of the branched radiation electrode 16 and the non-feed radiation electrode 18, respectively. For example, the branched radiation electrode 17 and the non-feed radiation electrode 19 are double-resonated in a frequency band of 1800 to 1900 MHz.

Figure 3A:
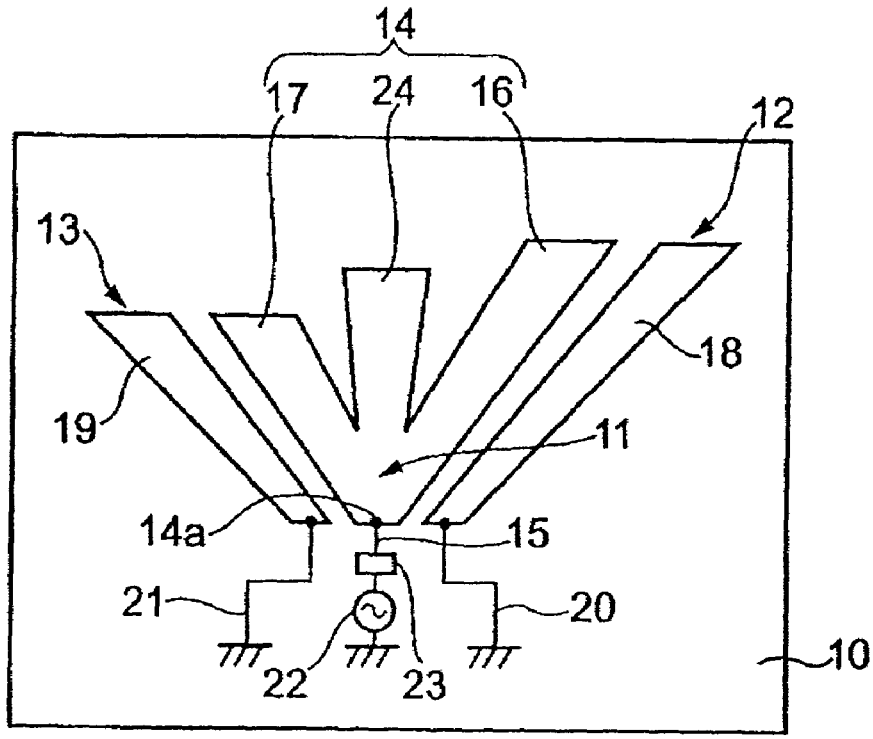
FIG. 3A is a schematic plan view showing the basic configuration of an antenna device according to preferred embodiments of the present invention.
Figure 3B:
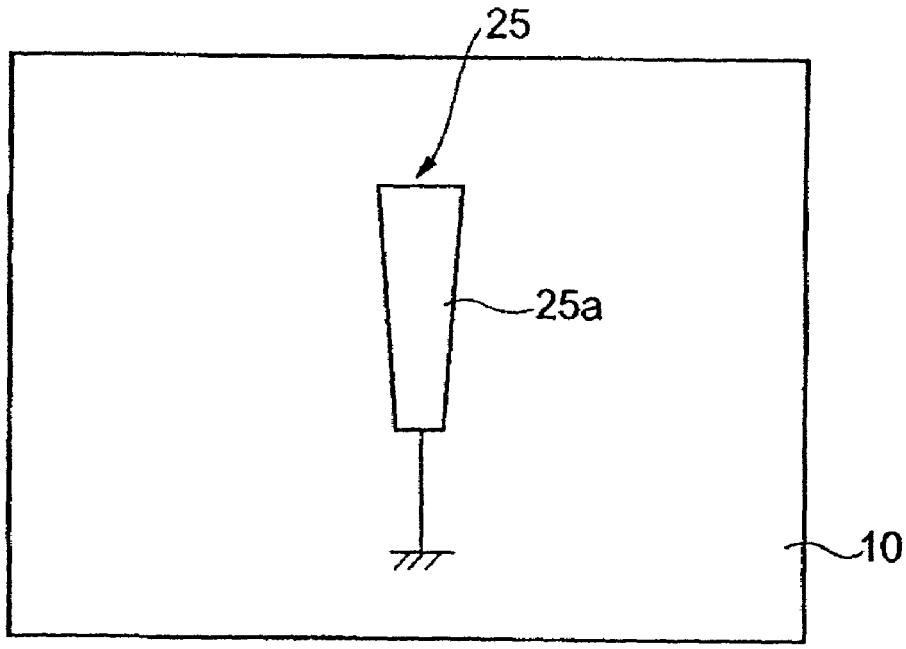
FIG. 3B is a schematic bottom view showing the basic configuration of the antenna device according to preferred embodiments of the present invention.

FIGS. 3A and 3B shows another preferred embodiment of the antenna device of the present invention. The same components as those in the preferred embodiment of FIG. 1 are designated by the same reference numerals. The repeated description of the same components is omitted. In this preferred embodiment, the feed radiation electrode 14 of the feed element 11 includes three branched radiation electrodes 16, 17, and 24.

In FIGS. 3A and 3B, the feed element 11 includes the feed radiation electrode 14 having the three branched radiation electrodes 16, 17, and 24. That is, in the configuration of the feed radiation electrode 14, the branched radiation electrodes 16, 17, and 24 having different lengths are branched from the common feeding end 14*a* to form a substantially W-shape. More particularly, the interval between the branched radiation electrodes 16 and 17 shown in FIG. 1 is increased. The third branched radiation electrode 24 is provided in the middle of the branched radiation electrodes 16 and 17.

The branched radiation electrode 24 has an effective line length which is between those of the branched radiation electrodes 16 and 17, and is excited at a resonance frequency f5 which is in a frequency band separated from the frequency bands of the branched radiation electrodes 16 and 17 (f2>f5>f1). Thus, the feed element 11 includes three electrical lengths, and includes resonance frequencies f1, f2, and f5 in the three frequency bands.

A non-feed element 25 which is paired with the branched radiation electrode 24 to be double-resonated is provided on the back surface of the substrate 10. That is, a non-feed radiation electrode 25*a* is provided on the back surface of the substrate 10 so as to extend along the branched radiation electrode 24. The non-feed radiation electrode 25*a* is configured in the same manner as the non-feed radiation electrodes 18 and 19. The ground end of the electrode 25*a* is connected to the ground terminal.

The non-feed radiation electrode 25*a* is electromagnetic-field-coupled to the branched radiation electrode 24, has an effective line length substantially equal to that of the branched radiation electrode 24, and is excited at a frequency f6 near the resonance frequency f5 of the branched radiation electrode 24. The branched radiation electrode 24 and the non-feed radiation electrode 25*a* are double-resonated in the same frequency band as that of the resonance frequencies f5 and f6. This frequency band is separated from the frequency bands of the resonance frequencies f3 and f4 of the non-feed element 12 and 13. The non-feed radiation electrodes 18 and 19 of the non-feed elements 12 and 13 are provided on the back surface of the substrate 10 similarly to the non-feed radiation electrode 25*a*. Thereby, the size of the substrate 10 is greatly reduced.

Figure 4A:
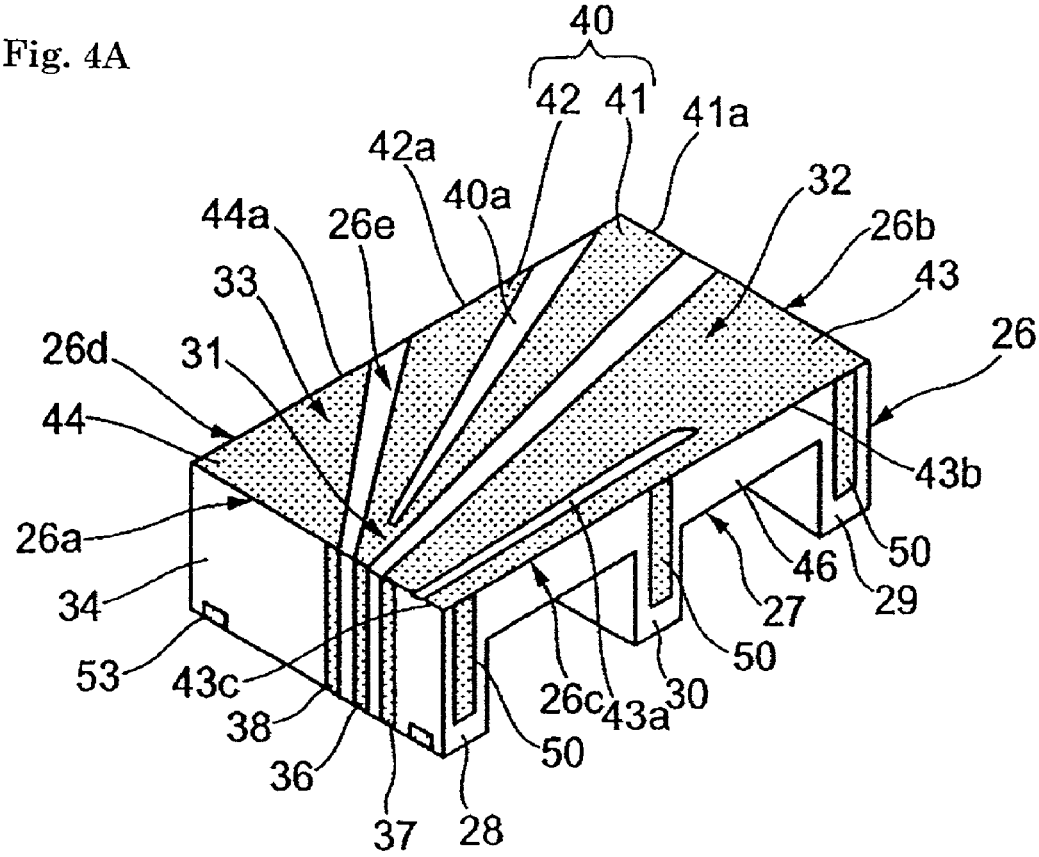
FIG. 4A is a perspective view showing the front-surface of an antenna device according to a preferred embodiment of the present invention.
Figure 4B:
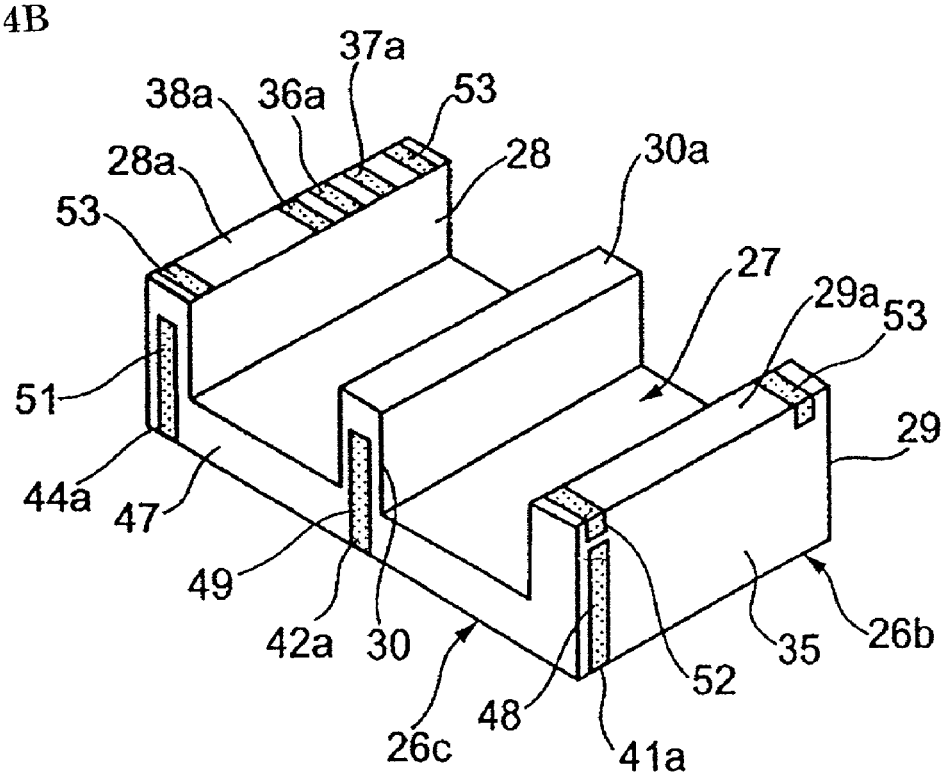
FIG. 4B is a perspective view showing the back-surface of the antenna device shown in FIG. 4A.
Figure 5:
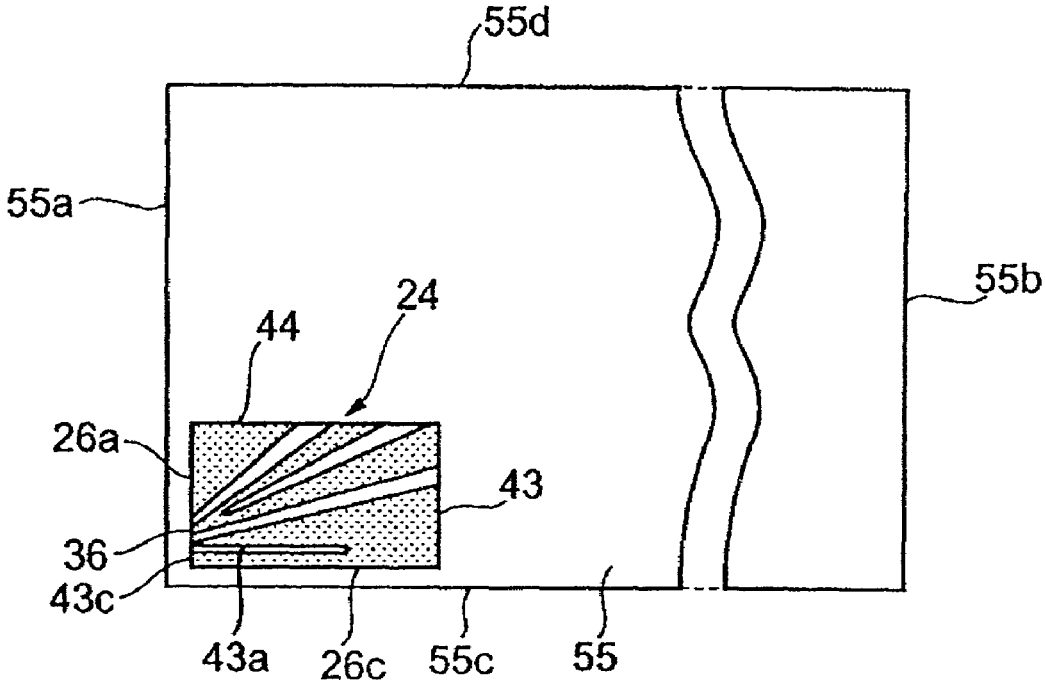
FIG. 5 is a plan view of another preferred embodiment of the present invention in which the antenna device of FIGS. 4A and 4B is mounted onto a circuit substrate for radio communication equipment.

FIGS. 4A, 4B, and 5 show an antenna device according to a first preferred embodiment of the present invention. FIGS. 4A and 4B show the antenna device, and FIG. 5 shows the antenna device mounted on a circuit substrate. This preferred embodiment is described using two feed elements and two non-feed elements.

Referring to FIGS. 4A and 4B, the antenna device includes a substrate 26 having a rectangular front surface 26*e*. The substrate 26 is made of a dielectric such as a ceramic material, a resin material, or other suitable dielectric material, or a magnetic material. The antenna device includes a top plate 27 having the flat surface 26*e*, two plate-shaped legs 28 and 29 provided along the short-edges 26*a* and 26*b* of the top plate 27 on both sides thereof in the longitudinal direction, and a center leg 30 in the approximate center of the top plate 27 and in parallel to the both legs 28 and 29. These legs 28, 29, and 30 are formed integrally with the top plate 27.

A feed element 31 and two non-feed elements 32 and 33 on both sides of the feed element 31 are provided on the top surface 26*e* of the substrate 26. Three strip electrodes 36, 37, and 38 are provided at a desired interval on the side-surface (leg side surface) on one short-edge side of the substrate 26. The strip electrodes 36, 37, and 38 extend in parallel to each other, in the direction from the bottom surface to the top surface 26*e* of the substrate 26 (vertical direction), positioned near one end in the side-surface in the short-edge direction. The center electrode defines a feed electrode 36, and the electrodes on the right and left sides define first and second ground electrodes 37 and 38, respectively. The lower end portions of these electrodes are bent to extend on the bottom 28*a* of the leg 28 to define feeding terminals 36*a* and ground terminals 37*a* and 38*a*, respectively.

The upper end of the feed electrode 36 is connected to a feed radiation electrode 40 provided on the top surface 26*e* of the substrate 26. The feed radiation electrode 40 is configured to gradually extend from the feed electrode 36 toward the corner on the left side of the top surface 26*e*. Moreover, the feed radiation electrode 40 includes an elongated triangular slit 40*a* gradually extending toward the corner which is provided in the plane of the electrode 40, such that two branched radiation electrodes 41 and 42 are provided.

In particular, the first branched radiation electrode 41 gradually extends from the vicinity to the feed electrode 36 toward the other short edge 26*b* of the top surface 26*e* of the substrate 26. The short edge 26*b* is an open end 41*a* of the electrode 41. The second branched radiation electrode 42 which is adjacent to the first branched radiation electrode 41 with the slit 40*a* being interposed between them, gradually extends from the vicinity of the feed electrode 36 toward the long-edge 26*d* on the left side which extends in the longitudinal direction of the substrate 26. The end of the electrode 42 defines an open end 42*a*. In this configuration, the first branched radiation electrode 41 has an effective line length greater than that of the second branched radiation electrode 42.

Two non-feed radiation electrodes 43 and 44 are provided on both sides of and close to the feed radiation electrode 40. In particular, the first non-feed radiation electrode 43 is disposed at a distance from and on the right side of the first branched radiation electrode 41, and has a quadrangle shape extending from the upper end of the first ground electrode 37, that is, from the short edge 26*a* to the opposed short edge 26*b*. A slit 43*a* is provided in the plane of the first non-feed radiation electrode 43 so as to extend from the short edge 26*a* in parallel to the right long-edge 26*c*. The long edge 26*c* defines an open end 43*b*, and the open end 43*c* at the top is on the short edge 26*a* which lies on the first ground electrode 37 side.

The second non-feed radiation electrode 44 is provided on the left side of and at a distance from the second branched radiation electrode 42, and extends from the short-edge 26*a* on the second ground electrode 38 side to the left long-edge 26*d*, which defines an open end 44*a*, forming a triangular shape. In this configuration, the effective line length of the second non-feed radiation electrode 44 is less than that of the first non-feed radiation electrode 43. Referring to the intervals between the feed radiation electrode 40 and the non-feed radiation electrodes 43 and 44, the intervals between them on the open end 41*a* and 42*a* side are greater than the intervals between the feed electrode 36 and the ground electrodes 37 and 38, respectively. Thereby, the intensity of the electric-field-coupling between the feed element 31 and the non-feed elements 32 and 33 is adjusted.

A strip-shaped capacitance-charging electrode 48 is provided on the side-surface 35 on the short-edge side which is opposite to the side surface 34 of the substrate 26 having the feed electrode 36 provided thereon. The electrode 48 connected to the open end 41*a* of the first branched radiation electrode 41 extends vertically from the short-edge 26*b*. The lower end of the capacitance-charging electrode 48 is opposed to a fixed ground electrode 52 at a desired interval. Thus, an open end capacity is provided between the capacitance-charging electrode 48 and the fixed electrode 52.

Moreover, a capacitance-charging electrode 49 is provided on the side-surface 47 on the long-edge 26*d* side of the substrate 26. The electrode 49 connected to the open end 42*a* of the second branched radiation electrode 42 vertically extends on the side surface of the center leg 30. Furthermore, a capacitance-charging electrode 51 is provided on the side surface 47 on the long-edge side, using the side surface of the leg 28. The electrode 51 connected to the open end 44*a* of the second non-feed radiation electrode 44 extends vertically from the long-edge 26*d*.

Similarly, capacitance-charging electrodes 50 are provided on the side surface 46 on the long-edge side opposite to the side surface 47 of the substrate 26. The electrodes 50 connected to the open end 43*b* of the first non-feed radiation electrode 43 extend vertically on the side surfaces of the three legs 28, 29, and 30. Furthermore, fixed electrodes 52 and 53 for fixing the antenna device onto a circuit substrate, which will be described later, are provided in the lower portions of the side surfaces 34 and 35 on the short-edge side and are bent to extend on the bottoms of the legs 28 and 29, respectively.

The above-described antenna device is mounted onto a circuit substrate 55 for radio communication equipment, as shown in FIG. 5. The antenna device is disposed such that the feed electrode 36 is directed toward the short side 55*a* of the circuit substrate 55. Moreover, the device is positioned near the corner of the circuit substrate 55 with the short edge 26*a* and the long edge 26*c* of the substrate 26 elongating along the short side 55*a* and the long side 55*c* of the circuit substrate 55, respectively.

In particular, the open end 43*b* of the non-feed radiation electrode 43 of the non-feed electrode 32 is adjacent to the long side 55*c* of the circuit substrate 55. The open end 43*c* at the top is adjacent to the short side 55*a* of the circuit substrate 55 from which the feed electrode 36 extends. The direction of the open end 43*c* bent by the slit 43*a* is opposite to the direction in which the long side 55*c* of the circuit substrate 55 extends, with respect to the feed electrode 36 of the antenna device. In other words, the open end 43*c* is opposite to the short side 55*b* which is opposed to the short side 55*a*.

The open end 44*a* of the non-feed radiation electrode 44 of the non-feed electrode 33 faces the other long-side 55*d* of the circuit substrate 55 which is opposed to the long-side 55*c* thereof. The direction of the open end 44*a* is the same as that in which the short side 55*a* extends, with respect to the feed electrode 36 side.

On the circuit substrate 55 on which the antenna device is disposed as described above, ground patterns are provided at the mounting positions for the antenna device, excluding wiring patterns which are connected to the feeding terminal 36*a* and function as the input-output terminal of a transmission-reception circuit not shown in the drawing, and also, wiring patterns for mounting other circuit components, such as impedance matching circuits and their peripheries. The bottoms 26*a*, 29*a*, and 30*a* of the legs 28, 29, and 30 provided on the substrate 26 of the antenna device are fixed thereon.

That is, the feeding terminal 36*a* are soldered to the input-output terminals of the transmission-reception circuits. The ground terminals 37*a* and 38*a* and the fixed electrodes 52 and 53 are soldered to the ground patterns. Elastic pins having spring properties may be used instead of the soldering. The tips of the capacitance-charging electrodes 48, 49, 50, and 51 are opposed to the ground patterns. Open end capacities are provided between the capacitance-charging electrodes 48, 49, 50, and 51 and the ground patterns. The circuit substrate 55 is defined by a single layer substrate or a laminated circuit substrate. The wiring patterns are defined by transmission-reception circuits for use with radio waves and signal processing circuits for base bands or other suitable circuits.

According to the above-described configuration, when signal power is supplied to the feeding electrode 36 via the impedance matching circuit, the feed element 31 is excited at the two resonance frequencies f1 and f2. That is, the first branched radiation electrode 41 having a greater effective line length is excited at the resonance frequency f1 which lies in the frequency band of, e.g., 800 to 900 MHz. The second branched radiation electrode 42 having a lesser effective line length is excited at the resonance frequency f2 which is higher than the resonance frequency f1 and lies in the frequency band of, e.g., 1800 to 1900 MHz.

The electric-field-coupling between the first and second branched radiation electrodes 41 and 42 is reduced, due to the slit 40*a* having an increased width in the directions of the open ends 41*a* and 42*a*, and the capacitance coupling between the capacitance-charging electrodes 48 and 49 and the ground patterns is suitably set. Thereby, the two resonance frequencies f1 and f2 occur independently of each other. In other words, the feed element 31 has two resonance characteristics which are independent of each other, caused by the electrical lengths which are determined by the two branched radiation electrodes 41 and 42, the two capacitance-charging electrodes 48 and 49, and the feed electrode 36.

The non-feed element 32 is electromagnetic-field-coupled to the feed element 31 such that excitation power is supplied to the element 32. In other words, the non-feed element 32 is excited at the resonance frequency f3, caused primarily by the current (magnetic field) coupling between the feeding electrode 36 and the ground electrode 37, the electric-field-coupling between the non-feed radiation electrode 43 and the first branched radiation electrode 41, and the capacitance coupling between the three capacitance-charging electrodes 50 and the ground patterns. The resonance frequency f3 is in the same frequency band as the resonance frequency f1 of the first branched radiation electrode 41, that is, in the frequency band of, e.g., 800 to 900 MHz.

In this case, the non-feed radiation electrode 43 is excited at the resonance frequency f3 which is lower than the resonance frequency f1 of the first branched radiation electrode 41. Thus, the feed element 31 and the non-feed element 32 are double-resonated at the resonance frequencies f1 and f3. The width of the frequency band in which the feed element 31 and the non-feed element 32 are double-resonated is greater as compared to the resonance characteristics for the resonance frequencies f1 and f3.

A case-current is excited along the long side 55*c* of the circuit substrate 55, due to the resonance current which flows toward the open end 43*c* at the top of the non-feed radiation electrode 43. The case-current increases the gain of the non-feed element 32 when the length of the long side 55*c* of the circuit substrate 55 is approximately half ($\lambda/2$) of the wavelength $\lambda$ of a used radio wave. Therefore, preferably, the length of the long side 55*c* of the circuit substrate 55 is substantially equal to the wavelength at the resonance frequency at which a high gain is achieved.

Moreover, since the first non-feed radiation electrode 43 is disposed near the long side 55*c* of the circuit substrate 55, the electric coupling between the open ends 43*b* and 43*c* and the ground patterns is reduced, such that the electrical Q factor of the resonance characteristic is decreased, and the frequency bandwidth is greatly increased.

Similarly, the non-feed element 33 is electromagnetic-field-coupled to the feed element 31 such that excitation power is supplied to the element 33. In other words, the non-feed element 33 is excited at the resonance frequency f4, caused primarily by the current (magnetic field)-coupling between the feeding electrode 36 and the ground electrode 38, the electric-field-coupling between the second non-feed radiation electrode 44 and the second branched radiation electrode 42, and the capacitance coupling between the capacitance-charging electrode 51 and the ground pattern. The resonance frequency f4 is in the same frequency band as the resonance frequency f2 of the second branched radiation electrode 42, that is, in the frequency band of, e.g., 1800 to 1900 MHz.

The non-feed radiation electrode 44 is excited at the resonance frequency f4 which is less than the resonance frequency f2 of the second branched radiation electrode 42. Thus, the feed element 31 and the non-feed element 33 are double-resonated at the resonance frequencies f2 and f4. The width of the frequency band in which the feed element 31 and the non-feed element 33 are double-resonated is greater as compared to the resonance characteristics of the single resonance frequencies f2 and f4. Then, a case-current is excited along the short side 55*a* of the circuit substrate 55, due to the resonance current which flows toward the open end 44*a* of the second non-feed radiation electrode 44.

The case-current increases the gain of the non-feed element 33. Moreover, since the second non-feed radiation electrode 44 is disposed near the short side 55*a* of the circuit substrate 55, the electric-field-coupling between the open end 44*a* and the ground pattern is decreased, and the electrical Q factor of the resonance characteristic is reduced. Thus, a wide frequency band is provided. As a result, the frequency bandwidth of the double-resonance characteristic is greatly increased.

The combination of the first branched radiation electrode 41 of the feed element 31 and the non-feed radiation electrode 43 defines a first double-resonant pair which provides a first frequency band. The combination of the second branched radiation electrode 42 and the second non-feed radiation electrode 44 defines a second double-resonant pair which provides a second frequency band separated from the first frequency band and being higher than the first frequency band. Accordingly, the antenna device is double-resonated in at least one of the frequency bands to produce a resonance characteristic having two peaks. Thus, the antenna device functions as a dual band antenna having a wide frequency band.

Referring to the substrate 26, the top plate 27 is supported by the legs 28, 29, and 30. Thus, the weight of the substrate 26 is greatly reduced. Moreover, for example, a circuit defining a portion of the transmission-reception circuit is arranged in the space between the center leg 30 and the legs 28 and 29 on both sides of the center leg 30. The thickness of the top plate 27 is less than the height of the legs 28, 29, and 30. Thus, the effective dielectric constant of the substrate 26 is greatly reduced, irrespective of the height of the substrate 26. Accordingly, excessive electric field coupling between the feed element 31 and the non-feed elements 32 and 33 is efficiently controlled, and the antenna characteristic is greatly improved.

An antenna device according to a second preferred embodiment of the present invention will be described with reference to FIGS. 6, 7A, and 7B. The same elements as those in the first preferred embodiment of FIGS. 4A and 4B are designated by the same reference numerals. The repeated description is omitted. The antenna device according to second preferred embodiment has a width that is substantially equal to one of the short sides of a substrate.

Figure 6:
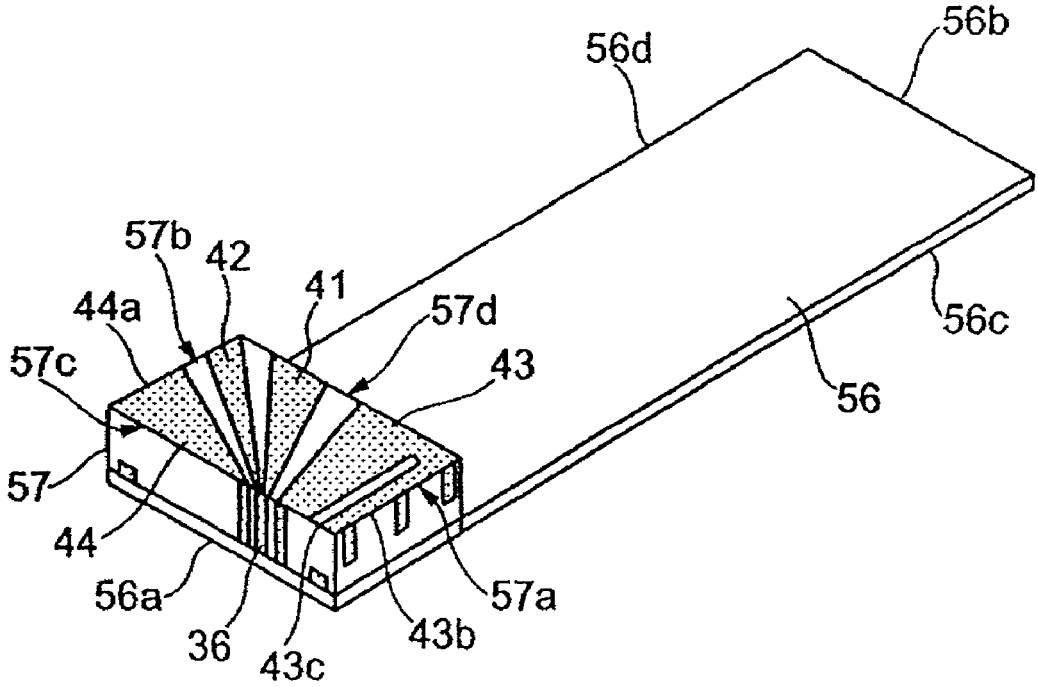
FIG. 6 is a plan view of another preferred embodiment of the present invention in which the antenna device is mounted onto a circuit substrate of radio communication equipment.

Referring to FIG. 6, a circuit substrate 56 to be incorporated into the case of a portable telephone is configured such that the ratio in length of the long sides 56*c* and 56*d* to the short sides 56*a* and 56*b* is in the range of about 2 to about 4. The substrate 57 of the antenna device is mounted on the circuit substrate 56, in which a long edge 57*c* of the substrate 57 is arranged along one short side 56*a* of the circuit substrate 56, and the short edges 57*a* and 57*b* are arranged along the long sides 56*c* and 56*d* of the circuit substrate 56. The length of the long edges 57*c* and 57*d* of the substrate 57 is equal to or slightly less than that of the short sides 56*a* and 56*b* of the circuit substrate 56.

The substrate 57 has a box-like shape in which an opening 58*a* is provided on the bottom 58. The thickness of the top plate 60 is less than the height of the side wall 59. A feed element 61 and non-feed elements 62 and 63 are provided on the front surface 60*a* of the substrate 57, similarly to the first preferred embodiment of FIGS. 4A and 4B. The feeding electrode 36 and the ground electrodes 37 and 38 of the feed element 61 and the non-feed elements 62 and 63 are provided on a wall 59*c* on the long-edge side of the substrate 57, near one end in the longitudinal direction of the wall.

The non-feed radiation electrode 43 connected to the upper end of the ground electrode 37 extends from a long edge 57*c* to the opposite long edge 57*d*. Open ends 43*b* and 43*d* divided by the slit 43*a* are connected to capacitance-charging electrodes 50 provided on the wall 59*a* on the right short-edge side of the substrate 57. On the other hand, the non-feed radiation electrode 44 connected to the ground electrode 38 extends along a long edge 57*c* to a right short-edge 57*b*, and the open end 44*a* is connected to the capacitance-charging electrode 51 provided on the wall 59*b* on the short-edge 59*b*.

The feed radiation electrode 40 defining the feed element 61, that is, the branched radiation electrodes 41 and 42 are provided between the non-feed radiation electrodes 43 and 44, similarly to the first preferred embodiment of FIGS. 4A and 4B. The open end 41*a* is connected to the capacitance-charging electrode 48 provided on the wall 59*d* on one long-edge side. The open end 42*a* is connected to the capacitance-charging electrode 49 provided on the wall 59*b* on the other short-edge side.

In the above-described configuration, the first branched radiation electrode 41 and the non-feed radiation electrode 43 are radiation electrodes defining a double-resonant pair, and are double-resonated, e.g., in a frequency band of 800 to 900 MHz. Moreover, the second branched radiation electrode 42 and the non-feed radiation electrode 44 are radiation electrodes which are double-resonated, e.g., in a frequency band of 1800 to 1900 MHz, and define a double-resonant pair.

The open end 43*b* of the non-feed radiation electrode 43 is arranged along the long side 56*c* of the circuit substrate 56, and the open end 43*c* at the top of the electrode 43 is arranged opposite to the direction in which the long side 56*c* extends (opposite to the direction of the short side 56*b*). That is, the open end 43*c* is positioned in the long edge 57*c* on the short-side 56*a* side in the vicinity of the ground electrode 37. Accordingly, case-current in the lower frequency band is excited along the long side 56*c* of the circuit substrate 56. This greatly improves the gain of the antenna.

Similarly, the non-feed radiation electrode 44 which functions in the higher frequency band is arranged along the short side 56*a* of the circuit substrate 56, and extends in the same direction as the short side 56*a*. The open end 44*a* is provided in the short-edge 57*b* which is on the long-side 56*d* side of the circuit substrate 56. Accordingly, case-current in the high frequency side, that is, having a frequency band of 1800 to 1900 MHz is excited on the edge of the substrate which is on the short-side 56*a* side of the circuit substrate 56. This greatly enhances the gain in the high frequency band.

Referring to the above-described excitation of the case-current, the non-feed radiation electrodes 43 and 44 are arranged in the end of the circuit substrate 56. Thereby, the electric field coupling between the non-feed radiation electrodes 43 and 44 and the circuit substrate 56 is reduced. Thus, the electrical Q factor of the resonance characteristic does not increase substantially, and moreover, the bandwidth is greatly increased. Moreover, the open end 43*b* of the non-feed radiation electrode 43 is provided on the long-side 56*c* side of the circuit substrate 56. The open end 44*a* of the non-feed radiation electrode 44 is provided on the long-side 56*d* side of the circuit substrate 56. Thus, the open ends 43*b* and 44*a* are spaced from each other. Thus, the mutual interference between the two double-resonant pairs is greatly reduced, and deterioration of the double-resonance characteristic is prevented.

Figure 7A:
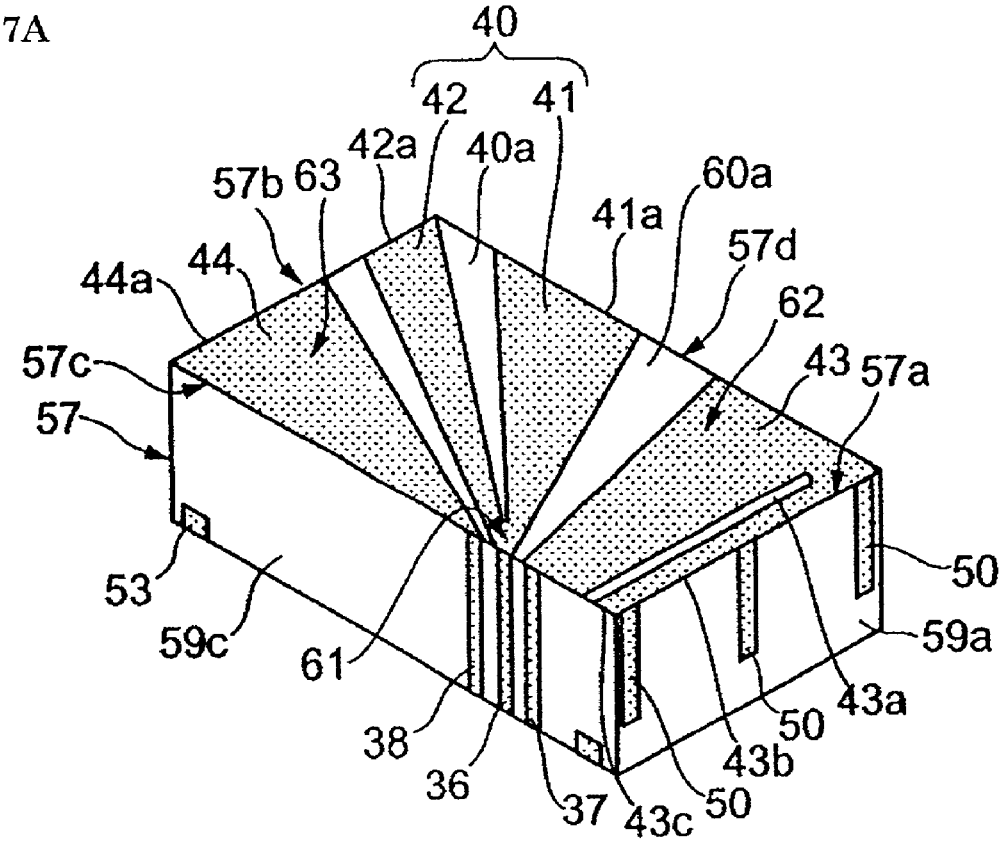
FIG. 7A is a perspective view showing the front surface of an antenna device according to another preferred embodiment of the present invention.
Figure 7B:
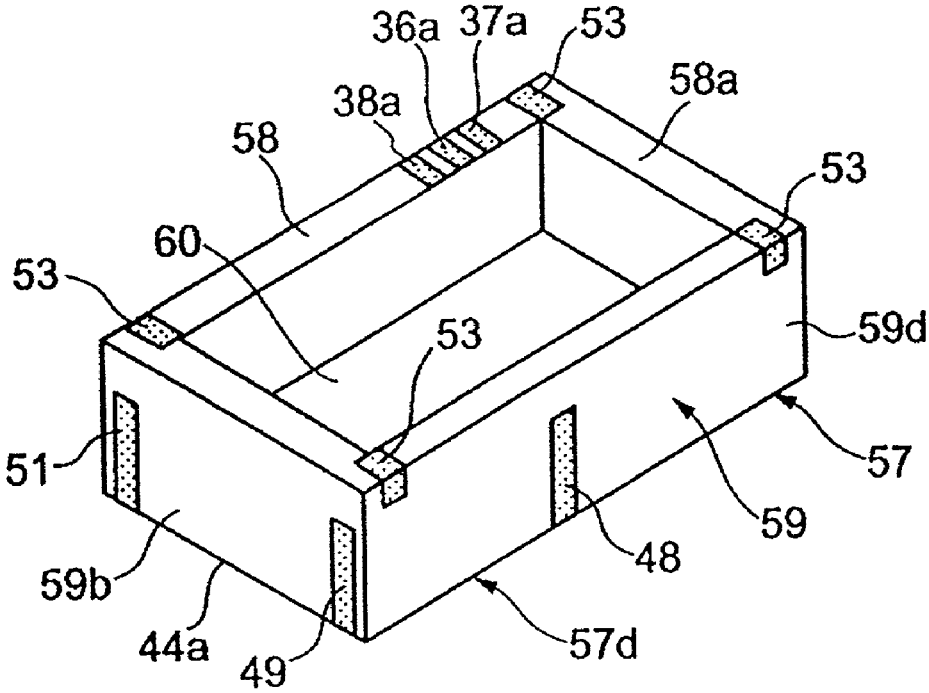
FIG. 7B is a perspective view showing the back surface of the antenna device shown in FIG. 7A.
Figure 8A:
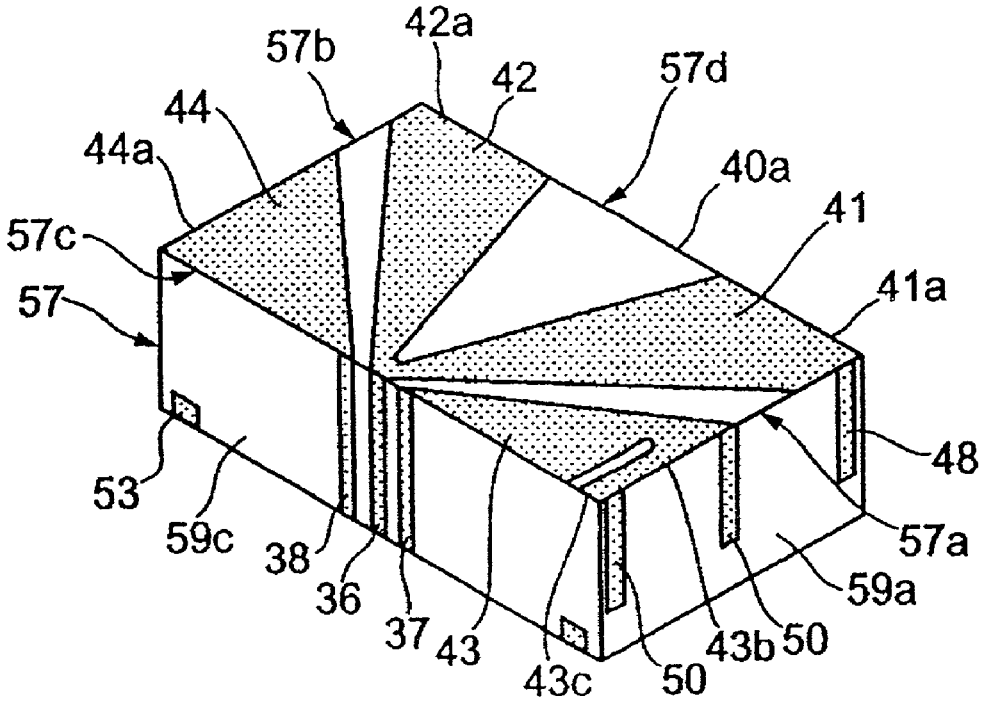
FIG. 8A is a perspective view showing the front surface of an antenna device according to still another preferred embodiment of the present invention.
Figure 8B:
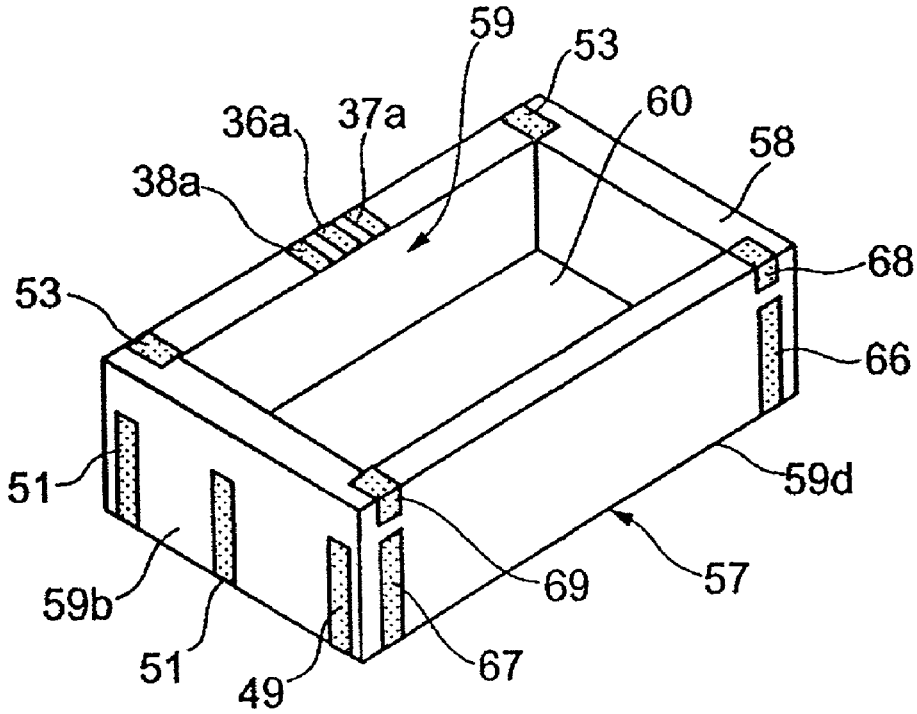
FIG. 8B is a perspective view showing the back surface of the antenna device shown in FIG. 8A.

FIGS. 8A and 8B show a third preferred of the antenna device shown in FIGS. 7A and 7B. The same elements as those in the second preferred embodiment of FIGS. 7A and 7B are designated by the same reference numerals. The repeated description is omitted. The third preferred embodiment includes a slit 40*a* provided in the feed radiation electrode 40 that is significantly enlarged.

Referring to FIGS. 8A and 8B, the feed electrode 36 and the ground electrodes 37 and 38 are provided on the wall 59*c* on one long-edge side of the substrate 57 in the approximate middle in the longitudinal direction of the wall 59*c*, similarly to the second preferred embodiment of FIGS. 7A and 7B. The branched radiation electrode 41 extends from the long edge 57*c* toward the corner at the right end of the long edge 57*d* opposed to the long edge 57*c*, has the open end 41*a* in the long edge 57*d* and the short edge 57*a*, and is connected to a capacitance-charging electrode 66 provided on the long-edge wall 59*d* of the substrate 57, and also the capacitance-charging electrode 48 provided on the short-edge wall 59*a* of the substrate 57. The top of the capacitance-charging electrode 66 is opposed to a fixed electrode 78 at a desired interval therebetween.

On the other hand, the branched radiation electrode 42 extends toward the corner at the left end of the long edge 57*b*, has the open end 42*a* on the long edge 57*d* and the short edge 57*b*, and is connected to a capacitance-charging electrode 67 provided on the long-edge wall 59*d* and also the capacitance-charging electrode 49 provided on the short-edge wall 59*b*. The top of the capacitance-charging electrode 67 is opposed to a fixed electrode 69 at a desired interval therebetween, similarly to the branched radiation electrode 41.

The slit 40*a*, which separates the branched radiation electrodes 41 and 42 from each other, widens from the feed electrode 36 side toward the long-edge 57*d* gradually and significantly. Thereby, the mutual interference between the two resonance frequencies of the branched radiation electrodes 41 and 42 is greatly reduced. In other words, the mutual interference between the double-resonant pair including the branched radiation electrode 41 and the non-feed radiation electrode 43 and the double-resonant pair including the branched radiation electrode 42 and the non-feed radiation electrode 44 is greatly reduced.

The non-feed radiation electrode 43 extends toward the right short-edge 57*a*, and the open ends 43*b* and 43*c* are positioned on the short edge 57*a* and the long edge 57*c*, respectively. The open end 43*b* is connected to the two capacitance-charging electrodes 50. The non-feed radiation electrode 44 extends toward the left short-edge 57*b*. The open end 44*a* positioned on the short edge 57*b* is connected to the two capacitance-charging electrodes 51 provided on the short-side wall 59*b*.

According to the above-described configuration, the open ends 41*a* and 42*a* of the two branched radiation electrodes 41 and 42 are separated from each other as much as possible. Thus, the band-separation between the two double-resonant pairs is greatly improved, and the characteristics of the respective double-resonant pairs are greatly improved. The antenna device is mounted on the circuit substrate 56 in a similar manner to that shown in FIG. 6, and case-current is excited along the sides 56*a* and 56*c* of the circuit substrate 56, similarly to the preferred embodiment of FIG. 6. Thus, the gain of the respective double-resonant pairs is greatly improved.

Figure 9A:
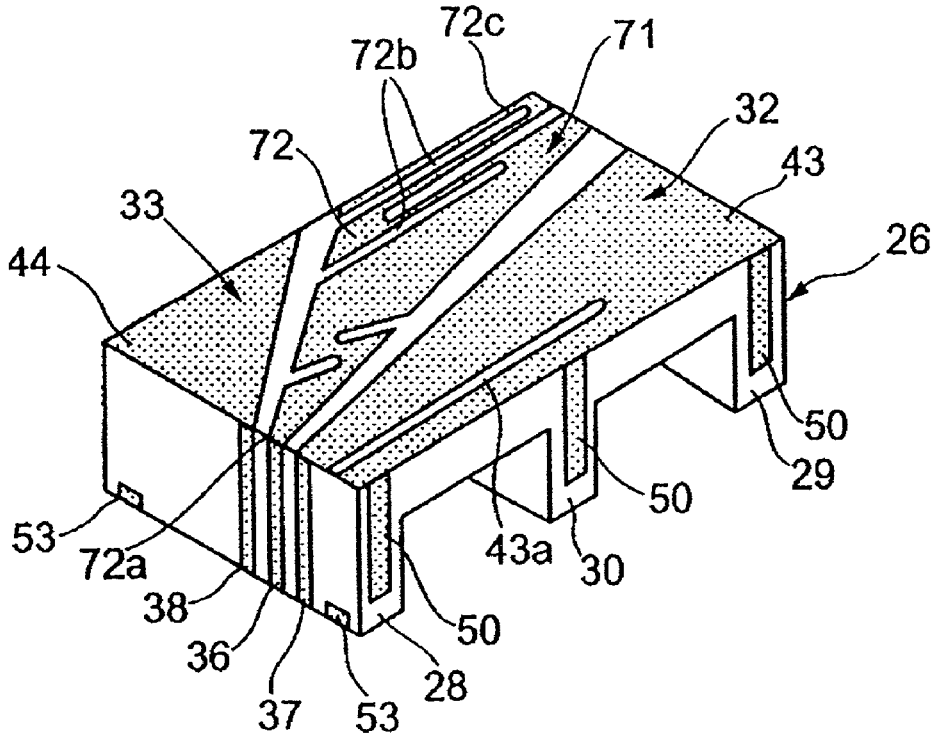
FIG. 9A is a perspective view showing the front surface of an antenna device according to yet another preferred embodiment of the present invention.
Figure 9B:
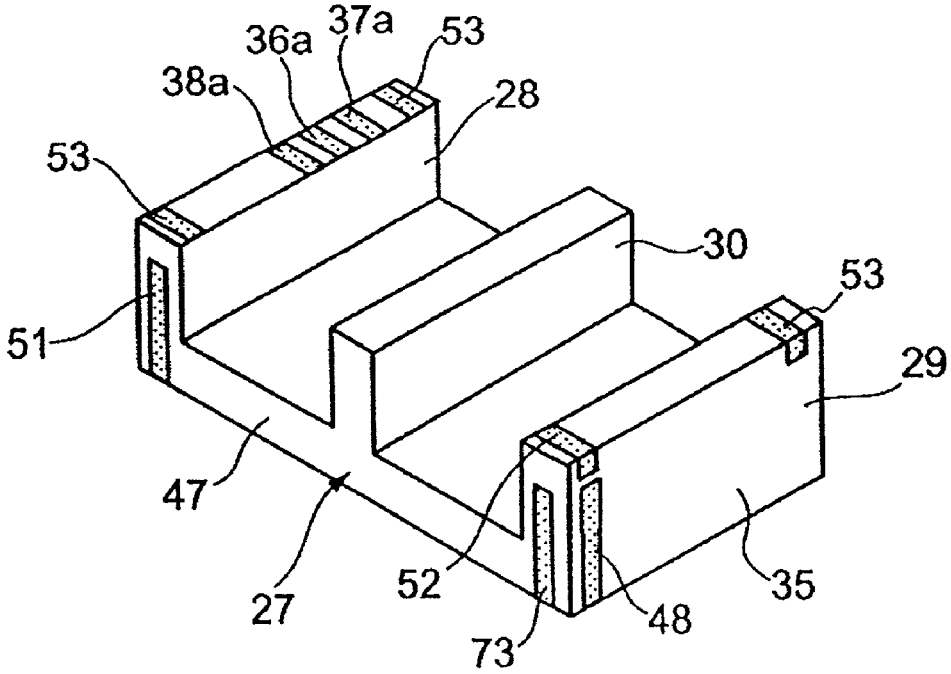
FIG. 9B is a perspective view showing the back surface of the antenna device shown in FIG. 9A.

FIGS. 9A and 9B show an antenna device according to a fourth embodiment of the present invention. The same elements as those in the first preferred embodiment of the FIGS. 4A and 4B are designated by the same reference numerals. The repeated description is omitted. The fourth embodiment is featured in that the feed element includes a single feed radiation electrode.

In FIGS. 9A and 9B, a feed element 71 includes a single feed radiation electrode 72 having a feeding end 72*a* which is the upper end of the feed electrode 36. A plurality of slits 72*b* are provided in the plane of the feed radiation electrode 72 to extend from the side-edges in the extension direction of the feed radiation electrode 72, and thereby, the effective line length of the feed radiation electrode 72 is appropriately set. The capacitance-charging electrode 48 provided on the short-edge wall 35 is connected to the open end 72*c* of the feed radiation electrode 72. Moreover, a capacitance-charging electrode 73 provided on the long-edge wall 47 is connected to the open end 72*c*. An electrostatic capacity is generated between the capacitance-charging electrode 48 and the fixed electrode 52. Also, an electrostatic capacity is generated between the capacitance-charging electrode 73 and the ground pattern.

The feed element 71, when signal power is supplied thereto via the feeding electrode 36, is excited at the resonance frequency of the fundamental wave and also at the resonance frequencies of the higher-order harmonics such as the double or triple harmonic wave. The resonance frequency of the fundamental wave is in the same frequency band as that of the non-feed element 32. Thus, the feed element 71 and the non-feed radiation electrode 32 are double-resonated. The resonance frequencies of the higher-order harmonics of the feed element 71 are in the same frequency band as the resonance frequency of the non-feed element 32. The feed element 71 and the non-feed element 33 are double-resonated at higher resonance frequencies than that of the non-feed element 32. In the above-described fourth preferred embodiment, the fundamental wave and the higher-order harmonics of the feed radiation electrode 72 are set with the slits 72*b*. However, this is not restrictive.

In any of the above-described preferred embodiments, the feed radiation electrodes 40 and 72 are connected to the feed electrode 36. The upper end of the feeding electrode 36 may be separated from the feed radiation electrodes 40 and 72 to provide a predetermined interval (gap) for capacitance-coupling.

Figure 10:
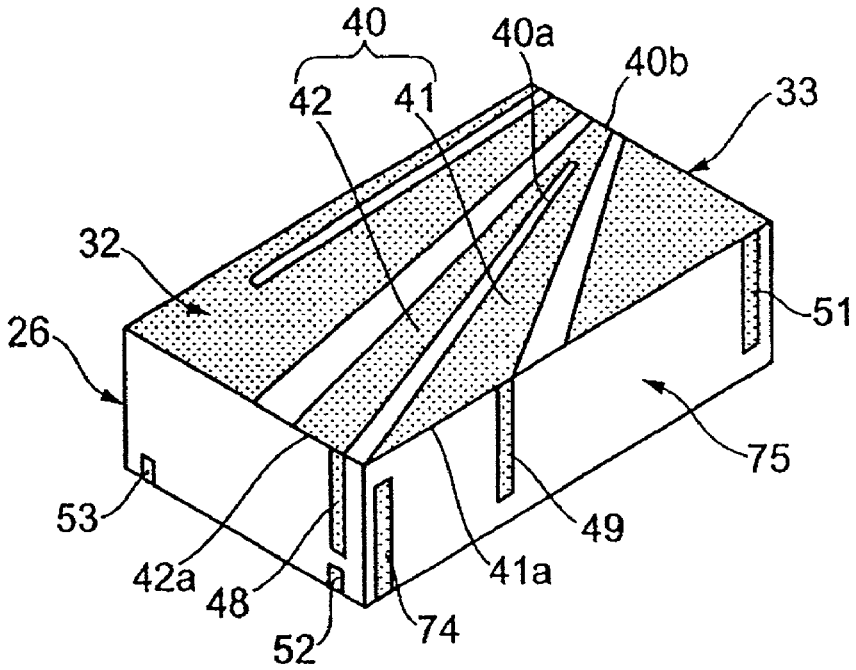
FIG. 10 is a perspective view showing another configuration of the feed terminal of an antenna device according to preferred embodiments of the present invention.

Moreover, as shown in FIG. 10, a feed electrode 74 is provided on the side-surface of a substrate 75 which is on the open-ends 41*a* and 42*a* side of the branched radiation electrodes 41 and 42. The tip of the feed electrode 74 is provided near the open ends 41*a* and 42*a* at a desired interval therebetween to be capacitance-coupled to the branched radiation electrodes 41 and 42. In this feeding configuration, the base end 40*b* of the branched radiation electrodes 41 and 42 is grounded via a ground electrode. In other words, the feeding electrode 36 in the above-described preferred embodiments defines the ground electrode.

Figure 11A:
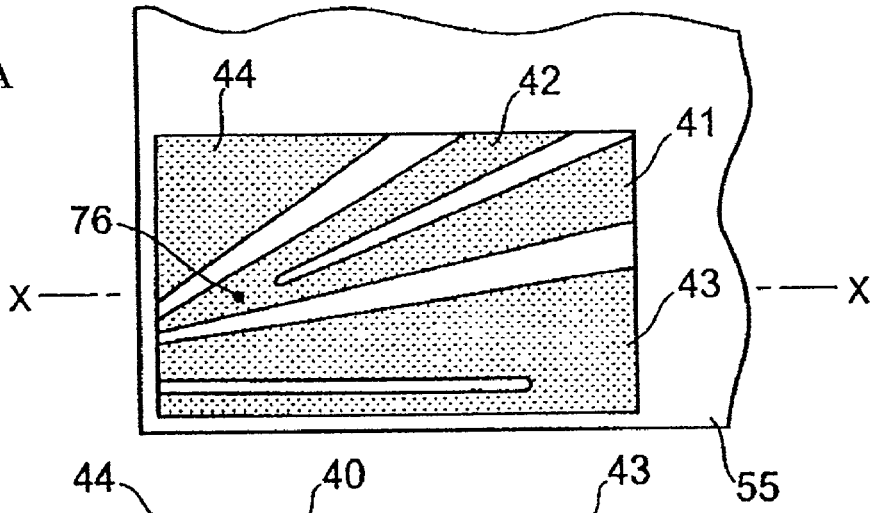
FIG. 11A is a plan view showing still another configuration of the feed terminal of the antenna device according to preferred embodiments of the present invention.
Figure 11B:
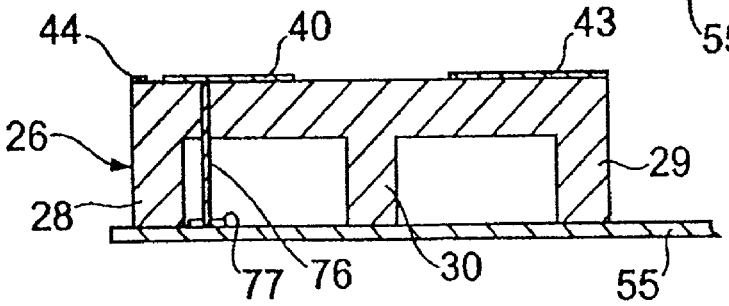
FIG. 11B is a cross-sectional view taken along alternate long and short dash line X—X in the antenna device of FIG. 11A.

Moreover, as shown in FIGS. 11A and 11B, a feeding pin passing through the top plate 27 of the substrate 26 is provided in the position of the base portion of the branched radiation electrodes 41 and 42 which is equivalent to about 50 Ω, such that signal power is supplied to the branched radiation electrodes 41 and 42 via the feeding pin 76. The lower end of the feeding pin 76 is connected to a feeding pattern 77 provided on the circuit substrate 55. The feed configuration of FIGS. 11A and 11B is the same as that of FIGS. 4A and 4B except that the feed electrode 36 defines the ground electrode.

Figure 12A:
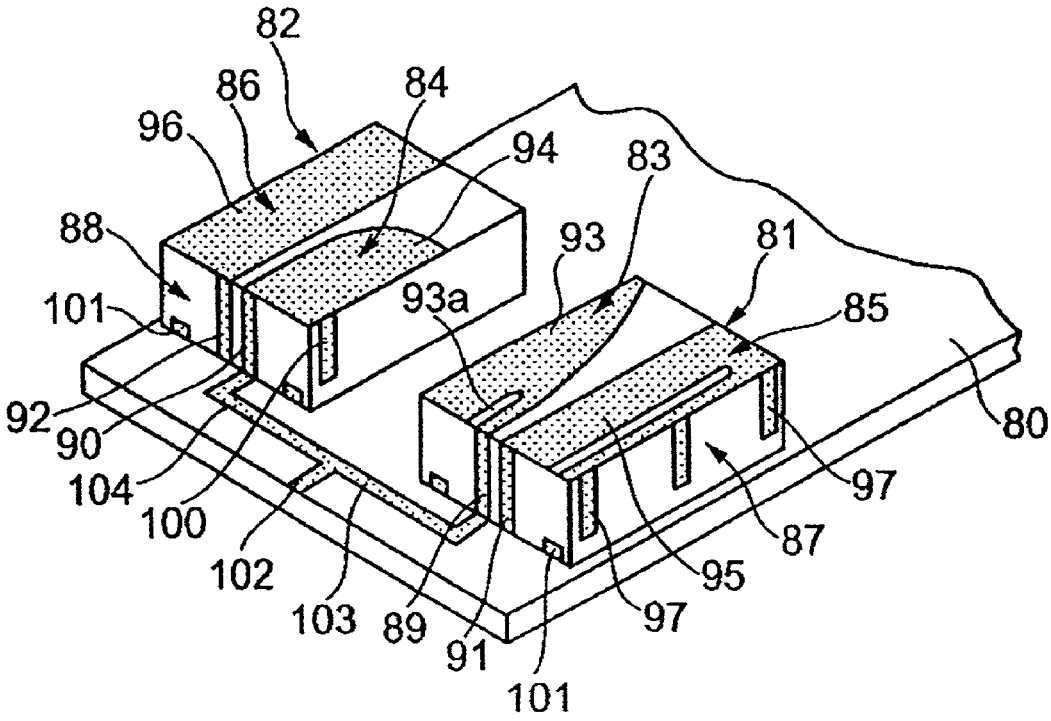
FIG. 12A is a perspective view showing the front surface of an antenna device according to another preferred embodiment of the present invention.
Figure 12C:
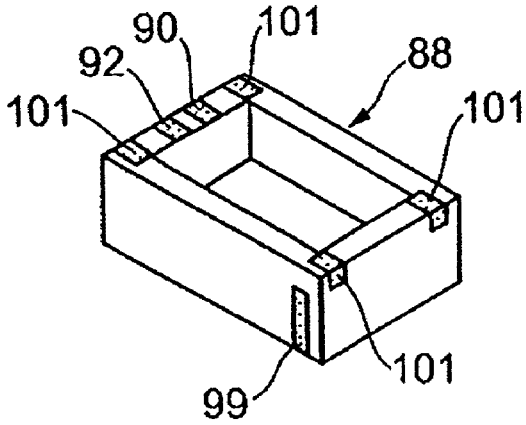
FIG. 12C is a perspective view showing the back surface of the other single antenna used in the antenna device shown in FIG. 12A.
Figure 12B:
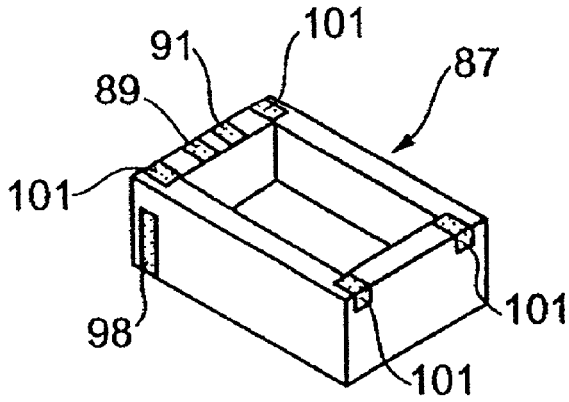
FIG. 12B is a perspective view showing the back surface of one single antenna used in the antenna device shown in FIG. 12A.

FIGS. 12A and 12B show an antenna device according to a fifth preferred embodiment of the present invention. This antenna device includes two single antennas that are mounted on a circuit substrate to define an antenna for use in dual bands.

Referring to FIGS. 12A and 12B, two single antennas 81 and 82 are mounted at a desired interval therebetween on a circuit substrate 80. These single antennas 81 and 82 are provided with feed elements 83 and 84 and non-feed elements 85 and 86 provided on substrates 87 and 88, respectively. The feed elements 83 and 84 are arranged adjacent to each other. The non-feed elements 85 and 86 are disposed on the outer side of the feed elements 83 and 84, respectively. The configurations of the substrates 87 and 88 are the same as that of FIGS. 7A and 7B, respectively.

The single antenna 81 is provided with a feed electrode 89 and a ground electrode 91 extending vertically on the side-surface on one short-edge side of the substrate 87. The feed electrode 89 and the ground electrode 91 are arranged in the vicinity of each other, in which the feed electrode 89 is located on the left side and the ground electrode 91 is located on the right side. A non-feed radiation electrode 95 connected to the upper end of the ground electrode 91 is provided on the front surface of the substrate 87 so as to extend at a constant width, in the longitudinal direction of the substrate 87, and is configured in the same manner as in FIGS. 4A and 4B. The open end of the electrode 95 is connected to a capacitance-charging electrode 97 provided on the side surface on one long-edge side of the substrate 87.

On the other hand, the feed radiation electrode 93, which is provided on the substrate 87, extends from the upper end of the feed electrode 89 in the longitudinal direction of the substrate 87, gradually bending so as to be spaced further from the non-feed radiation electrode 95. The open end of the feed radiation electrode 93 is connected to a capacitance-charging electrode 98 which is provided on the side surface on the long-edge facing the single antenna 82, at a location relatively near the feed electrode 89. A slit 93*a* is provided in the plane of the feed radiation electrode 93 so as to extend from the feed electrode 89 side, and thereby, the effective line length of the feed radiation electrode 93 is adjusted.

In the single antenna 82, a feed electrode 90 and a ground electrode 92 are provided on the side surface on one short-edge side of the substrate 88, in which the feed electrode 90 is located on the right side, and the ground electrode 92 is located on the left side, similarly to the single antenna 81. On the surface of the substrate 88, a non-feed radiation electrode 96 connected to the upper end of the ground electrode 92 extends at a constant width, along the left side of the substrate 88 in the longitudinal direction of the substrate 88. The open end at the top of the electrode 96 is connected to a capacitance-charging electrode 99 provided on the side surface on the long-edge side of the substrate 88.

A feed radiation electrode 94 extends from the upper end of the feed electrode 90 approximately halfway in the longitudinal direction of the substrate 88, and thereafter, bends in an arch shape so as to be quickly separated from the non-feed radiation electrode 96. That is, the effective line length of the 94 is set to be less than that of the feed radiation electrode 93. The open end of the feed radiation electrode 94 is connected to a capacitance-charging electrode 100 which is provided on the side surface of the long-edge side facing the single antenna 81, at a position relatively near the feed electrode 90. Fixed electrodes 101 are provided.

A common feeding terminal pattern 102 and feeding patterns 103 and 104 connected to the pattern 102 are provided in the end portion of the circuit substrate 80 having the two single antennas 81 and 82 mounted thereon. The feed electrode 89 of the single antenna 81 is connected to the feed pattern 103. The feed electrode 90 of the single antenna 82 is connected to the feed pattern 104. The ground electrodes 90 and 91 and the fixed electrodes 101 are connected to ground patterns not shown in the drawing. The tops of the capacitance-charging electrodes 97, 98, 99, and 100 are opposed to ground patterns not shown in the drawing.

According to the above-described configuration, the feed element 83 and the non-feed element 85 of the single antenna 81 are double-resonated in the same frequency band, for example, in a frequency band of 800 to 900 MHz. The feed element 84 and the non-feed element 86 of the single antenna 82 are double-resonated in the same frequency band higher than that of the single antenna 81, for example, in a frequency band of 1800 to 1900 MHz. Accordingly, the feed radiation electrodes 93 and 94 operate similar to branched electrodes having the feeding terminal pattern 102 as a base portion thereof, similarly to the feed element 31 shown in FIG. 4.

According to the antenna device formed using the circuit substrate 80, the interval between the single antennas 81 and 82 is increased, depending on the area of the circuit substrate 80. Thus, the mutual interference between the single antennas 81 and 82 is greatly reduced. The electrical volume of the antenna device required corresponding to the uses is determined by the size of the circuit substrate 80. The arrangement of the single antennas 81 and 82 is easily changed.

In the antenna device according to the preferred embodiment of FIGS. 12A and 12B, band-stop circuits 105 and 106 is provided in the middle of the feed patterns 103 and 104. In particular, the band-stop circuit 105 is a filter circuit which interrupts a signal in the frequency band of the single antenna 82 and transmits a signal in to the frequency band of the single antenna 81. On the other hand, the band-stop circuit 106 is a filter circuit which interrupts a signal in to the frequency band of the single antenna 81 and transmits a signal in to the frequency band of the single antenna 82.

According to this circuit-configuration, for the single antennas 81 and 82, the feed elements provided with consideration to the excitation conditions only, and matching for the double-resonation is easily achieved.

Figure 13:
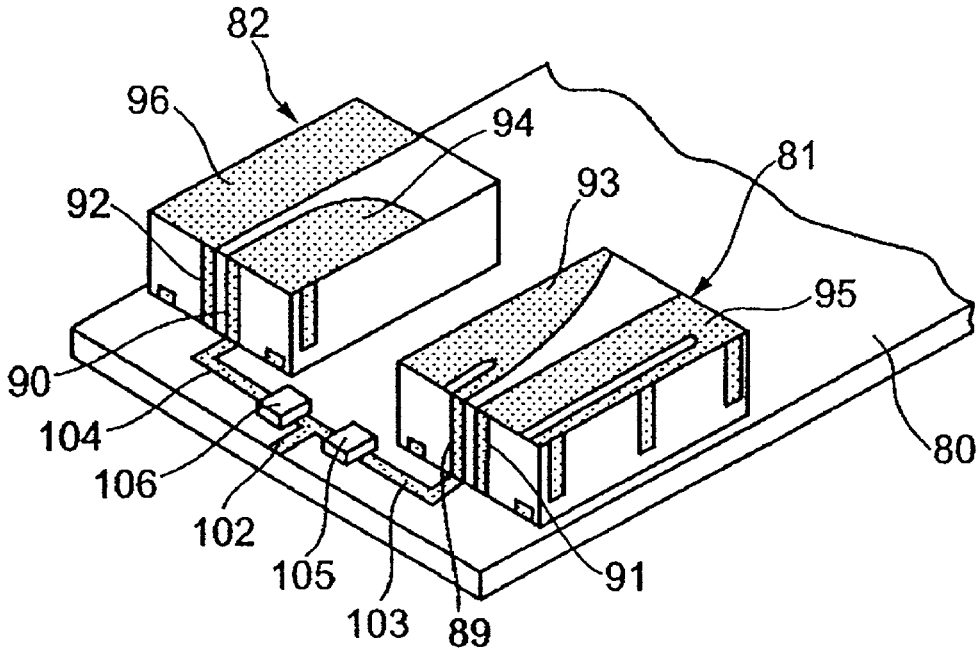
FIG. 13 is a perspective view showing another preferred embodiment of the antenna device of FIG. 12A.

In the preferred embodiments of FIGS. 12A and 12B and 13, the single antennas 81 and 82 may have the configuration of the antenna device shown in FIGS. 4A and 4B, instead of the configurations of FIGS. 12A, 12B, and 12C and 13, respectively. That is, the single antennas 81 and 82 may include the non-feed radiation elements that are arranged on both sides of the feed element, respectively. The single antennas 81 and 82 of this antenna device constitute dual-band antennas each having two frequency bands. That is, this antenna device is a multi-band antenna having a total of four frequency bands. Accordingly, when the antenna device is mounted on radio communication equipment, the respective frequency bands are sequentially changed for used, or can be simultaneously used.

Figure 14:
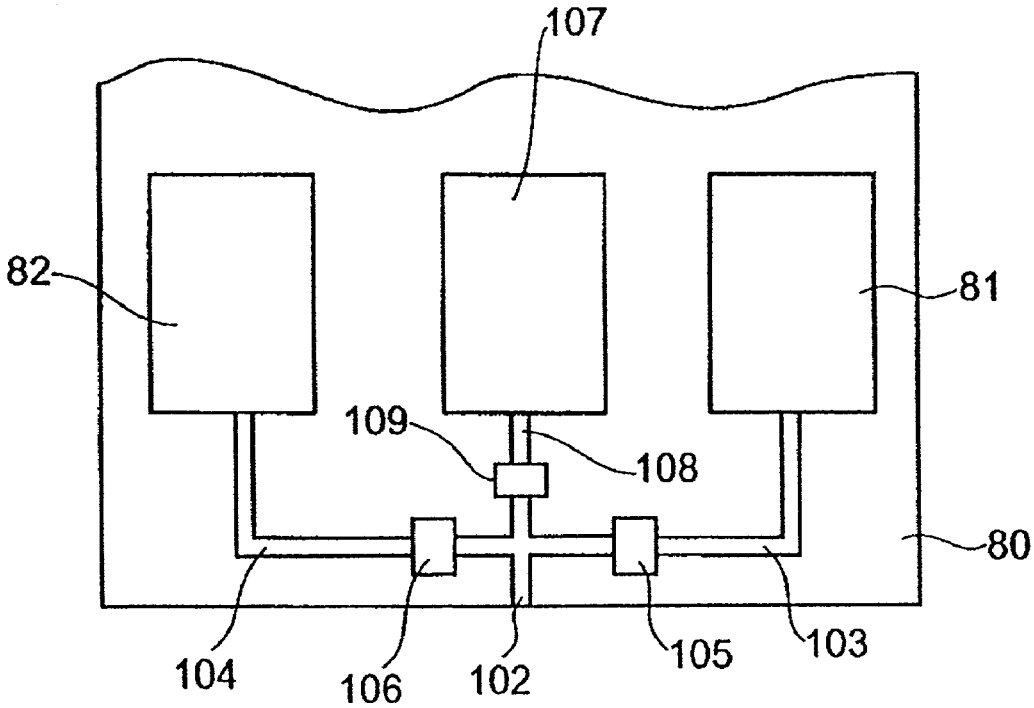
FIG. 14 is a plan view showing an antenna device according to still preferred another embodiment of the present invention.
Figure 15:
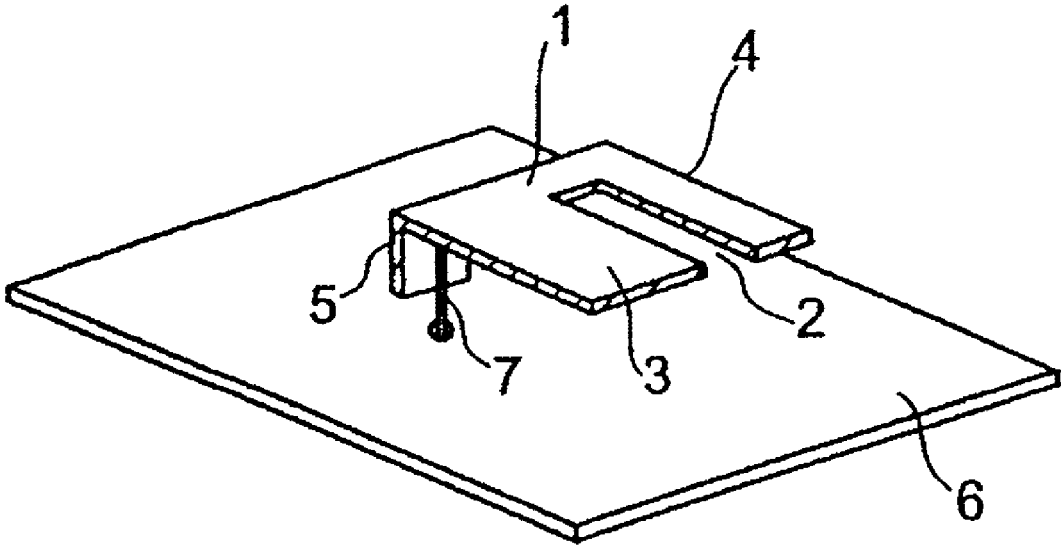
Fig. 15 PRIOR ART
FIG. 15 is a perspective view of an antenna device of the related art.

Moreover, a single antenna 107 having the same configuration as that of the respective single antennas 81 and 82 shown in FIG. 13 may be added. As shown in FIG. 14, the single antenna 107 is arranged between the single antennas 81 and 82. The feed electrode for the single antenna 107 is connected to the feeding terminal pattern 102 via a feeding pattern 108. A filter circuit 109 is provided in the approximate middle of the feeding pattern 108, similarly to the single antennas 81 and 82.

The feed element and the non-feed element of the single antenna 107 are double-resonated. Thus, the antenna device has three frequency bands. For example, when the frequency band of the single antenna 81 is 800 to 900 MHz, the frequency band of the single antennas 107 and 82 are 1800 to 1900 MHz and 2700 to 2800 MHz, respectively.

Since the non-feed elements are arranged near and along the feed element, optimum electromagnetic field coupling between the respective non-feed elements and the feed element is set for each non-feed element. Double-resonance is effectively achieved in each of the frequency bands to which the resonance frequencies of the non-feed elements belong, respectively. Thus, the bandwidths of the frequency bands are greatly increased as compared to an antenna of the related art having two frequency bands as single resonance characteristics, respectively. Accordingly, the bandwidth of the antenna device is greatly increased, while greatly reducing the size and height of the antenna device.

Preferably, the feed radiation electrode includes a plurality of branched radiation electrodes. Accordingly, a plurality of resonance frequencies in different frequency bands is provided for one feed element. Moreover, since the branched radiation electrodes have effective line lengths, respectively, the resonance frequencies are individually set.

Also, preferably, the branched radiation electrodes have effective line lengths at which the electrodes are excited at different resonance frequencies. Therefore, the resonance frequencies are easily set, provided that resonance frequencies of the frequency bands do not overlap each other. The frequencies are set for the branched radiation electrodes.

Preferably, the single feed electrode has an effective line length at which the single feed radiation electrode is excited at the resonance frequencies of the fundamental wave and the higher-order harmonics. Thus, the branched radiation electrodes corresponding to the respective resonance frequencies are unnecessary. Accordingly, the volume of the antenna device is reduced, and the size of the antenna device is reduced.

Preferably, the interval between the adjacent branched radiation electrodes of the feed element increases on the open-end side. Therefore, deterioration of the double-resonance characteristic, which is caused by the mutual interference between the double-resonance pairs, reduction of the frequency bandwidths and deterioration of the antenna gain are prevented.

Preferably, the capacitance-charging electrodes are provided in the open ends of the radiation electrodes. Accordingly, the open end capacities of the radiation electrodes have definite values. Thereby, the resonance frequencies of the radiation electrodes are easily set, and outstanding matching of the double-resonance is achieved.

Also, preferably, the at least two non-feed radiation electrodes are arranged along the sides of the circuit substrate, respectively. Therefore, the gains of the non-feed elements are improved, respectively, and also, the bandwidths of the non-feed elements are increased.

According to the present invention, the plurality of antennas is mounted onto the circuit substrate. The volumes of the antennas is determined by the size of the circuit substrate. Accordingly, the size of the antenna device is optionally increased, and the design of the antenna device, e.g., change of the antenna layout, is easily achieved.

Preferably, signal power is supplied to the respective antennas via the filter circuits. Therefore, the design of the feed element for superior matching of the antennas is easily achieved.

Preferably, each antenna is configured so as to be double-resonated in two frequency bands. Thus, a multi-band antenna is easily achieved, and moreover, the space required for mounting the antennas in the radio communication equipment is greatly reduced.

The number of options for configuration of the feeding terminal is increased, due to the terminal pin preferably provided as the feeding terminal.

According to the radio communication equipment of the present invention, the width of the antenna device is substantially equal to the length of the short sides of the circuit substrate, and the antenna device is arranged along the three sides of the circuit substrate. Therefore, the space of the circuit substrate is efficiently utilized, and case currents are excited in the circuit substrate to improve the gain of the antenna device. Moreover, since the open ends of the non-feed radiation electrodes are separated as much as possible, the double-resonance is achieved in wide frequency bands. Moreover, interference between the frequency bands is greatly reduced.

In the radio communication equipment, preferably, the open end at the top of the non-feed radiation electrode on the low frequency side is arranged in the direction opposite to that in which the long side of the circuit substrate elongates so as to be more distant from the non-feed element. Therefore, the circuit substrate is utilized as an antenna for operation at a low frequency, such that the gain of the antenna is improved.

According to the radio communication device of the present invention, which uses one of the antenna devices of the present invention having wide and plural frequency bands due to the double-resonance, radio communication in the plural frequency bands is achieved with one antenna device. Thus, the size of the radio communication device is further reduced.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. An antenna device comprising:

a substrate made of one of a dielectric material and a magnetic material;

a feed element disposed on the substrate and including a feeding terminal and a feed radiation electrode electrically coupled to the feeding terminal, the feed radiation electrode including a plurality of branched radiation electrodes, each of the plurality of branched radiation electrodes having one common end and extended ends defining open ends; and a plurality of non-feed elements disposed on the substrate, each of the plurality of non-feed elements including a ground terminal and a non-feed radiation electrode electrically coupled to the ground terminal, the non-feed radiation electrode extending from the ground terminal and including an extended end defining an open end; wherein each of the plurality of non-feed radiation electrodes is disposed along and in the vicinity of a respective one of the plurality of branched radiation electrodes of the feed radiation electrode;

each of the non-feed radiation electrodes is disposed along an outer edge of the respective one of the plurality of branched radiation electrodes of the feed radiation electrode;

a space between adjacent ones of the plurality of branched radiation electrodes gradually increases from the common end to the open ends;

each of the plurality of branched radiation electrodes has a resonant frequency in a different frequency band from the remaining one of the plurality of branched radiation electrodes, and each of the plurality of non-feed radiation electrodes has a resonant frequency in a different frequency band from that of the remaining one of the plurality of non-feed radiation electrodes, such that each of the plurality of non-feed radiation electrodes disposed along and in the vicinity of a respective one of the plurality of branched radiation electrodes defines a double-resonance pair, and each of the double-resonance pairs double-resonate at a frequency band that is different from the remaining double-resonance pairs.

2. An antenna device according to claim 1, wherein each of the plurality of non-feed radiation electrodes is disposed along and in the vicinity of the respective one of the plurality of branched radiation electrodes such that a space between the non-feed radiation electrode and the respective branched radiation electrode gradually increases from the common end to the open ends.

3. An antenna device according to claim 1, wherein the feed terminal is connected to the common end of the plurality of branched radiation electrodes.

4. An antenna device according to claim 1, wherein the plurality of branched radiation electrodes have effective line lengths at which the branched radiation electrodes are excited at different resonant frequencies.

5. An antenna device according to claim 1, wherein three strip-shaped electrodes extending from the bottom surface to the top surface in parallel with each other are located on the same side surface of the substrate, and the electrode of the three strip-shaped electrodes disposed in the middle defines the feeding terminal, and the other electrodes of the three strip-shaped electrodes define the ground terminals.

6. An antenna device according to claim 1, wherein capacitance-charging electrodes are provided on side-surfaces of the substrate at the open ends of the plurality of branched radiation electrodes.

7. An antenna apparatus comprising the antenna device defined in claim 1, and a substantially rectangular circuit substrate, the substrate of the antenna device is arranged near a corner of the circuit substrate where two sides of the circuit substrate intersect each other with one of the plurality of non-feed elements being arranged along one of the two sides and another of the plurality of non-feed elements being arranged along the other side.

8. An antenna apparatus comprising a plurality of the antenna device defined in claim 1, and a circuit substrate having the plurality of antenna devices disposed thereon and including a ground pattern connecting the ground terminals to each other and a feeding pattern connecting the feeding terminals to a common signal source.

9. An antenna apparatus according to claim 8, wherein filter circuits are provided in paths of the feeding pattern which is branched from the portion thereof connecting the feeding terminals to the common signal source and extended toward the feeding terminals, respectively.

10. An antenna device according to claim 1, wherein the plurality of branched radiation electrodes includes two branched radiation electrodes and the non-feed radiation electrodes are disposed on both sides of and near the feed radiation electrode on the surface of the substrate.

11. An antenna device according to claim 1, wherein the feeding terminal is a feed electrode provided on a side-surface of the substrate.

12. An antenna device according to claim 1, wherein the feeding terminal is a terminal pin passing through the substrate.

13. Radio communication equipment comprising the antenna device defined in claim 1, and a circuit substrate having an elongated substantially rectangular shape with long and short sides;

the antenna device having a width substantially equal to the length of one short side of the circuit substrate and being arranged along one short side and both long sides of the circuit substrate; and the open end of one of the non-feed radiation electrodes being arranged along one of the two long sides of the circuit substrate, and the open end of another of the non-feed radiation electrodes being arranged along the other long side.

14. Radio communication equipment according to claim 13, wherein a distal portion of the open end of one of the non-feed radiation electrodes having the longest effective line length is arranged so as to be close to the short side along which the antenna device is arranged.

15. Radio communication equipment comprising the antenna device defined in claim 1 and a circuit substrate including a transmission-reception circuit for radio waves, each ground terminal of the antenna device being connected to a ground terminal of the circuit substrate, and the feeding terminal being connected to an input-output terminal of the transmission-reception circuit.

* * * * *